United States Patent [19]

Kinoshita et al.

[11] Patent Number: 4,943,501

[45] Date of Patent: Jul. 24, 1990

[54] PHOTOCONDUCTIVE MATERIAL CONTAINING ANTI-OXIDANT

[75] Inventors: Akira Kinoshita, Hino; Yumi Matsuzawa, Fuchu; Hideo Yoshizawa, Hachioji, all of Japan

[73] Assignee: Konica Corporation, Tokyo, Japan

[21] Appl. No.: 415,390

[22] Filed: Sep. 28, 1989

Related U.S. Application Data

[63] Continuation of Ser. No. 167,505, Mar. 14, 1988, abandoned.

[51] Int. Cl.[5] ..... G03G 5/14

[52] U.S. Cl. ..... 430/58; 430/56; 430/59; 430/60; 430/66; 430/67

[58] Field of Search ..... 430/56, 58, 59, 60, 430/66, 67, 551, 613

[56] References Cited

U.S. PATENT DOCUMENTS

| | | | |
|---|---|---|---|
| 4,232,103 | 11/1980 | Limburg et al. | 430/59 |
| 4,397,931 | 8/1983 | Limburg et al. | 430/58 X |
| 4,526,864 | 7/1985 | Takada et al. | 430/551 |
| 4,563,408 | 1/1986 | Lin et al. | 430/59 |

*Primary Examiner*—Roland E. Martin

*Attorney, Agent, or Firm*—Finnegan, Henderson, Farabow, Garrett and Dunner

[57] ABSTRACT

A photoconductive element having improved physical properties is disclosed. The photoconductive element comprises an electro-conductive substrate, a photoconductive layer containing a photoconductive material and, optionally, a protective layer, wherein either one of said photoconductive layer or said protective layer contains a compound which has in its molecular a hindered amine structure unit represented by formula [Ia] and a hindered phenol structure unit represented by formula [Ib];

[Ia]

[Ib]

wherein, $R_1$, $R_2$, $R_3$ and $R_4$ independently represent a hydrogen atom, an alkyl group, or an aryl group; Z represents a group of atoms necessary to complete a nitrogen-containing alicyclic group; $R_5$ represents an alkyl group; $R_6$ is a branched alkyl group; $R_7$, $R_8$ and $R_9$ independently represent a hydrogen atom, a hydroxy group, an alkyl group, or an aryl group; and $R_{10}$ represents a hydrogen atom, an alkyl group, or an alkeny group; provided that said hindered amine structure unit is connected through one of $R_1$, $R_2$, $R_3$, $R_4$, $R_5$ and Z thereof, optionally through a divalent organic group and/or one of $R_6$, $R_7$, $R_8$, $R_9$ and $R_{10}$, with said hindered phenol structure unit, and that $R_8$ and $R_9$ may be connected with each other to form a ring.

12 Claims, 1 Drawing Sheet

PHOTOCONDUCTIVE MATERIAL CONTAINING ANTI-OXIDANT

Figure 1:
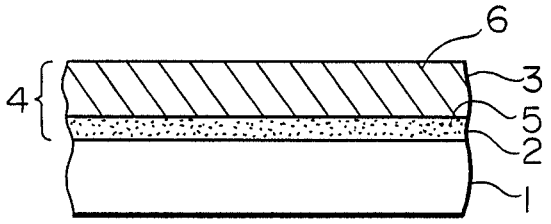

This application is a continuation of application Ser. No. 167,505, filed Mar. 14, 1988, now abandoned.

FIELD OF THE INVENTION

This invention relates to a photoconductive element, and especially to the improvement in a photoconductive element using an organic photoconductive material.

BACKGROUND OF THE INVENTION

In an electro-photographic copier using Carlson process, after uniformly charging the surface of the photoconductive element, an electrostatic latent image is formed by imagewise exposure, and then the electrostatic latent image is developed with toner. The developed toner image is made to be a visual image by being transfer to a recording sheet and fixed thereon.

Thereafter, the photoconductive element is subject to removal of toner adhered to the surface thereof, discharging, and cleaning and, thus, is repeatedly used for a long period.

Therefore, the electro-photoconductive element is required to have improved electro-photoconductive properties such as charging property, sensitivity and reduced dark decay. Also, such physical properties as durability, abrasion-proof, moisture-proof under repetitive use and durability against ozon generated during corna discharge or against ultra-violet rays used for exposure, etc. are required to be good.

Up to now, as a photoconductive element for electrophotography, sensitive elements which comprises photoconductive layer containing, as its principal component, selenium, zinc oxide, cadmium sulfide, etc. have widely been used.

In the other hand, use of organic compounds as a photoconductive material has been actively studied and developed. For example, Japanese Patent Examined Publication No. 10496/1975 refers to organic photoconductive element containing in the photoconductive layer a poly-N-vinycarbazole and a 2,4,7-trinitro-9-fluorenone.

But this photoconductive element is not always satisfactory in sensitivity and durability. In order to avoid such disadvantage, an atempt to develop an organic photoconductive element having enhanced sensitivity and durability has been made, wherein charge generating function and charge transporting function are separately assigned to different materials in the photoconductive layer. Like this in the function-separated electrophotographic element, compounds having respective functions can be chosen from wide variety of compounds and, thus, production of a photoconductive element having optional properties becomes relatively easy.

Recently, quite a few compounds which are useful as a charge generating material for function-separated type photoconductive element have been proposed. As an example, in which an inorganic substance is used, anorphous selenium which is disclosed in Japanese Patent Examined Publication No. 16198/1969 may be mentioned. This is used in combination with an organic charge transporting material.

Many electro-photoconductive elements which uses organic dye or pigment as a charge generation material have been proposed. For example, photoconductive element having a photoconductive layer which contains bis-azo compound are disclosed in Japanese Patent Publication Open to Public Inspection No. 37543/1972, 22834/1980, 79632/1979 and 116040/1981.

However, in electro-photographic process especially, repeated using causes reduction of charging property because of the exposure time accumulatively increases to ozon and active materials.

SUMMARY OF THE INVENTION

Object of the present invention is to provide a novel photoconductive element which has improved resistance against surrounding atmosphere, especially against ozone and has improved properties in the charging ability under repititious copying operation, in the dark conductivity and in the sensitivity.

The present invention specifically relates to a photoconductive element comprising an electro-conductive substrate, a photoconductive layer containing a photoconductive material and, optionally, a protective layer, wherein at least one of said photoconductive layer and said protective layer contains a compound which has in its molecular a hinderred amine structure unit and a hindered phenol structure unit.

'Hindered amine structure unit' is a structure unit characterized in that a bulky atomic group is present around amino nitrogen, and for example, aromatic amino groups and aliphatic amino groups belong to this group. Especially, aliphatic amino groups can give remarkable effect to suit for the object of this invention.

'Hindered phenol structure unit' is defined as a structure unit which is characterized in that a bulky atomic group is present at the ortho position of phenolic hydroxy group.

In general, a alkyl group is preferable as the bulky atomic group.

The mechanism of its working effect is not clear, but it is assumed that the steric hindrance caused by the bulky atomic group has a restrictive effect on that the thermal oscillation of the amino nitrogen atom or the phenolic hydroxy group, or it prevents the influence of outer-active substance.

According to the preferable embodiment of the present invention, the hindreed amine structure unit has the following formula (Ia), and the hindered phenol structure unit has the following formula (Ib):

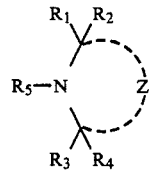

(Ia)

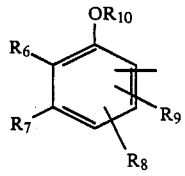

(Ib)

Wherein, $R_1$, $R_2$, $R_3$ and $R_4$ independently a hydrogen atom, an alkyl group or an aryl group. It is preferable that at least one of $R_1$ and $R_3$ is an alkyl group. $R_5$ represents an alkyl group. Z represents a group of atoms which is necessary to complete a nitrogen-containing alicyclic compound.

$R_6$ represents a branched alkyl group; $R_7$, $R_8$ and $R_9$ independently represent a hydrogen atom, a hydroxy group, an alkyl group or an aryl group. $R_8$ and $R_9$ may mutually combine with each other to form a cycle. $R_{10}$ represents a hydrogen atom, an alkyl group or an alkenyl group.

The forgoing $R_1$, $R_2$, $R_3$, $R_4$ and $R_5$ are, preferably, alkyl groups having 1–10, preferably 1–3 carbon atoms. The alkyl group may be saturated or unsaturated. Also, the alkyl group may be streight chained or branched. Further, cyclic one may also be used. For example, methyl group, ethyl group, n-propyl group, iso-propyl group, butyl group and t-butyl group are given. The alkyl group may optionally have a substituent such as alkoxy, alcohol, amide, halogen, etc. The hindered amine structure unit of the invention may preferably be combined with the hindered phenol structure, through one of $R_1$ to $R_5$, or Z, on the amine structure unit side, directly or through an organic divalent group, with the phenyl ring either directly or through one of $R_6$ to $R_{10}$. Further, $R_1$ and $R_2$, and/or $R_3$ and $R_4$ may be combined with each other to form a ring.

Z is a group of atoms necessary to complete a nitrogen-containing alicyclic compound, preferably an atomic group which structures 5-member ring or 6-member ring. Preferable cyclic structures are as follows: A piperidine, a piperazine, a morpholine, an pyrrolidine, an imidazolidine, an oxazolidine, a thiazolidine, a selenazolidine, a pyrroline, an imidazoline, an isoindoline, a tetrahydroisoquinoline, a tetrahydropyridine, a dihydropyridine, a dihydroisoquinoline, an oxazoline, a thiazoline, a selenazoline, a pyrrole, etc. Most preferable cyclic structures are a piperidine, a piperazine and a pyrrolidine.

Above mentioned $R_6$ is preferable a tertiary or secondary alkyl group having 3–40 carbon atoms.

As the alkyl group for $R_7$, $R_8$ and $R_9$ one having 1–40 carbon atoms is preferable, one having 1–10 carbon atoms is more preferable. As the aryl group, phenyl, naphthyl, pyridine, etc. are given.

When $_8$ and $R_9$ form a ring, chroman ring is preferable. Hydrogen atoms is most preferable for $R_{10}$, and one having 1–18 carbon atoms is preferable for alkyl and alkenyl group.

As linkage between the hindered amine structure unit (Ia) and the hindered phenol structural unit (Ib), any divalent organic linkages such as alkylene or ether bondage, etc., but it is advantageous to use ester linkage or amide linkage for the reason of synthesis. The compound which includes structure units of (Ia) and (Ib) may be a polymer, but for the reason of easy purification, which is usually required for a material used for electrophotoconductive element, a compound having relatively low molecular weight is preferable.

In the sense of increasing number of —OH or NR structure unit contained in a unit volume, it is preferable that the material has a molecular weight of not more that 1500.

According to one preferable embodiment of the present invention, the photoconductive materials to be used in the sensitive layer preferably consists of Charge Generating Material (hereinafter referred to as CGM) and Charge Transporting Material (hereinafter referred to as CTM). These CGM and CTM may be present in the same layer or in different layers.

The photoconductive element which comprises a compound having structure unit represented by formulae (Ia) and (Ib) is chemically stable under the conditions of ozone atomosphere, ultraviolet exposure and/or high temperature, while the conventionally known amine compounds in general tend to induce increase of residual potential and sharp decrease of sensitivity. By the use of the compound of the invention these detriments can be lessened. The Compounds which only have a hindered amine structure unit, when add to photoconductive element, bring about similar technical effects to those of the present invention, however in this case, with the increase of its content, the decrease in the sensitivity tends to take place. On the other hand, the compound which only has hindered phenol structure unit is less effective against ozone compared with hindered amine compound.

Further, even in the case where the hindered amine compound and the hindered phenol compound are used in combination, the advantageous effects of the respective compounds are not necessarily exerted and satisfactory ozon-proof and sensitivity cannot be obtained.

The compound of this invention, which has both structure units in one molecule, accompanis little lowering of sensitivity even with increased amount of use and gives outstanding effect against ozone while keeping high sensitivity. Simultaneously, the compound of the present invention gives excellent effect of decreasing temperature dependency of sensitivity, especially in the low tempareture region.

This effect is specific to the compound in which nitrogen atom of the hindered amine structure unit (Ia) is alkylated, i.e., $R_5$ is an alkyl group, has structure unit (Ib) in same molecule.

Typical examples of such compound which has both structure units represented by the above-mentioned formulae (Ia) and (Ib) and is preferably used in this invention, are as follows:

A: Exemplified compounds which have hindered amine and phenol structure units:

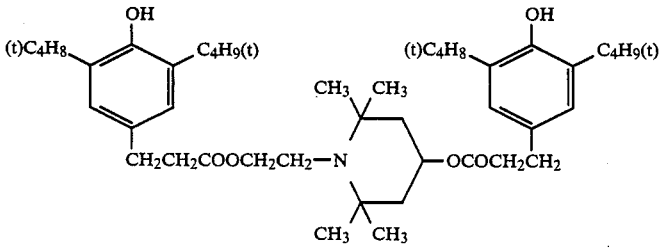

A-1

-continued
A-2
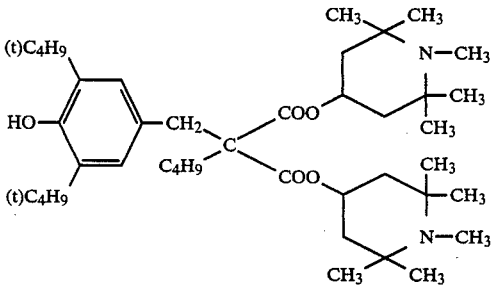
A-3
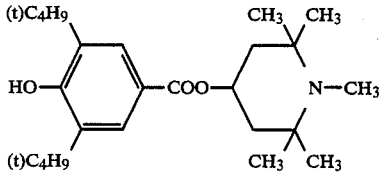
A-4
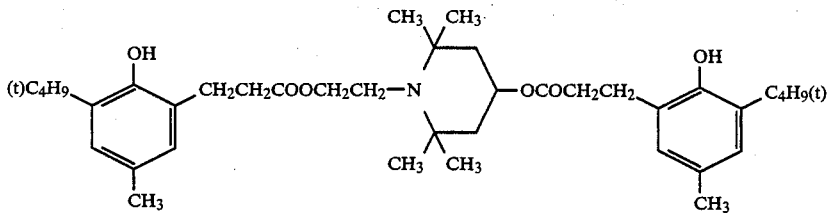
A-5
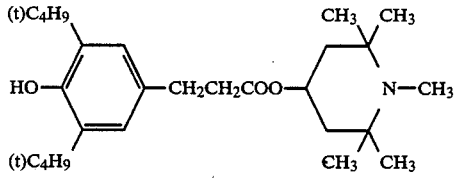
A-6
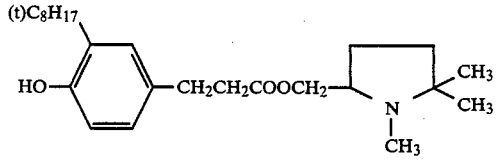
A-7
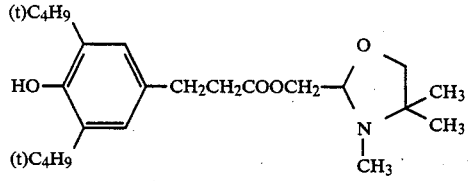
A-8
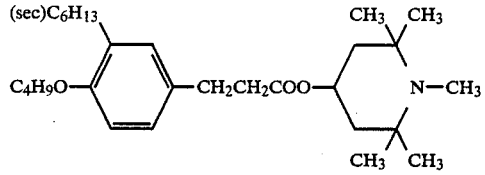
A-9
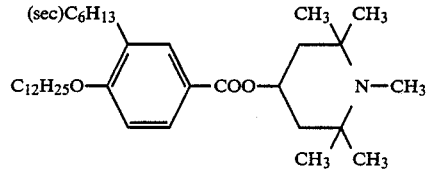

-continued

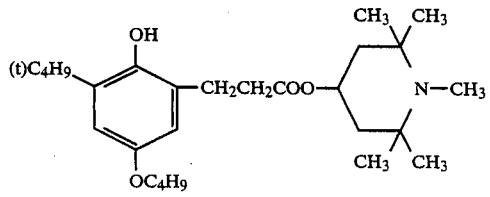

A-10

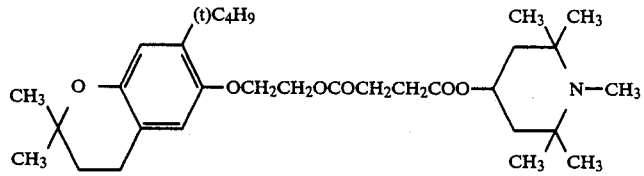

A-11

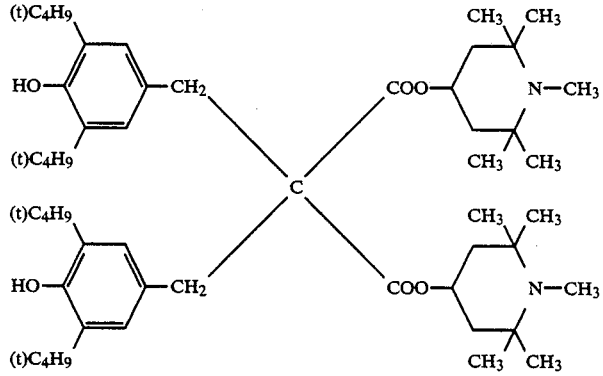

A-12

These compounds are known as light-stabilizers, for example, as Tinuvin-144, Ingaperm-1994, Sanol-LS-2626 (manufactured by Sankyo Co., Ltd.), and are able in the market. Also, these compounds can be according to a method disclosed, for example, in Japanese Patent O.P.I. Publication.

Amount of addition of the compounds of this invention may be varied depending upon the nature of the structure of photoconductive layers and kinds of CTM, but when added to CGL, 0.1–200 parts by weight, and especially 0.1–100 parts by weight, with respect to 100 parts by weight of CGM is preferable.

When the compound is added to intermediate layer, a protective layer or a subbing layer, 0.01.–200 parts by weight with respect to 100 parts by weight of a binder resin.

As regards the total quantity of the compound to be added to the photoconductive element, it is important to relate with the total quantity of CTM and 0.01–70 parts by weight with respect to 100 parts by weight of CTM.

Structure of the photoconductive element of this invention will be hereinafter described with reference to the drawing.

According to one of the embodiments of the invention, the photoconductive element has a layer structure as shown in FIG. 1, wherein the photoconductive element comprises a substrate 1, which is made of an electrically conductive material or of a sheet of which surface is provided with an electrically conductive layer, and provided thereon a photoconductive layer 4 consisting of a charge generating layer (CGL) 2, which contains a charge generating material (CGM) 5 and, if required, a binder resin, and a charge transporting layer (CFTL) 3 containing a charge transporting material (CTM) 6 and, if required, a binder resin.

Figure 2:
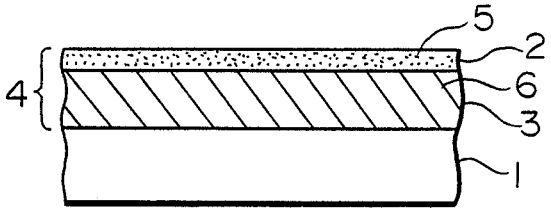
Figure 3:
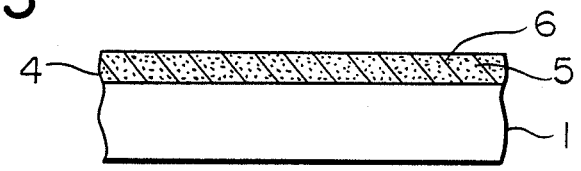

According to other embodiments of the invention, the photoconductive element may have a layer structure as shown in FIG. 2, Photoconductive layer 4, which consists of CLT 3 as lower layer and CGL 2 as upper layer is, is provided on the electro-conductive substrate 1. According to another embodiment of the invention, the photoconductive element has a layer structure as shown in FIG. 3, wherein a single photoconductive layer 4 containing CGM, CTM and, if necessary, a resin is provided on the electro-conductive substrate 1.

According to the most preferable embodiment of the present invention, the effect of the invention can be exerted in the photoconductive element comprising CGL as upper layer and CTL as lower layer.

The compound of this invention may be contained in CGL, CTL which structures a single-layered or a multi-layered photoconductive layer, or in the OCL, or in the plurality of layers mentioned above allows contains in multi-layers. Multi-layer-photoconductive which is CGL as upper layer and CTL as lower layer.

In order for the advantages of the present invention to be exerted, the compound of the present invention is preferably incorporated, at least, into one of the outermost layer and a layer containing CTM.

Figure 4:
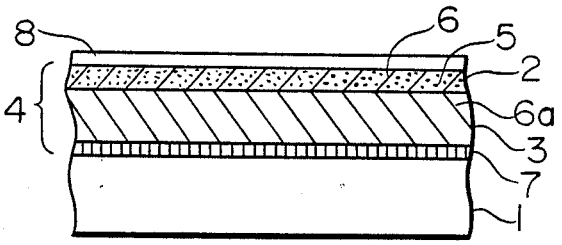

To be concrete, it is preferable for the compound of the present invention to be contained in the CTL 3 of FIG. 1, in the CTL 3 of FIG. 2, in the photoconductive layer 5 of FIG. 3, or in the protective layer 8, the photoconductive layer 4 containing CTM and CGM and/or the CTL 3 of FIG. 4.

The compound of the present invention may also be incorporated in the other layers including a subbing layer or in the whole constructural layers.

Next, as the charge generating material which is preferable in the invention, those which absorp visual lihgt and generate free charge, may be used either inorganic pigments or organic dyes. Examples of inorganic pigments and they are amorphous selenium, trigonal seleniums, selenium-arsenis alloy, selenium-tellurium alloy, cadmium sulfide, cadmiumsulfoselenide, sulfoselenide, murcury sulfide, lead oxide and lead sulfide. Organic pigments are exemplified as follows:

(1) Azo pigments such as monoazo pigments, polyazo pigments, metal complex azo pigments, pyrazolone azo pigments, stilbenzo azo and thiazole azo pigments;

(2) Perylene pigments such as perylene anhydrides, peryleneacid imide pigments (3) Anthraquinone pigments or Polycyclic pigments such as anthraquinone derivatives, anthanthrone derivatives dibenzpyrene quinone derivatives, pyranthrone derivatives, violanthrone and isoviolanthrone derivatives;

(4) Indigo pigments such as indigo derivatives and thioindigo derivatives;

(5) Phthalcyanine pigments such as metallic phthalocyanines and non-metallic phthalocyanines;)

(6) Carbonium pigments such as diphenylmethane pigments, triphenylmethane pigments, xanthene pigments and acridine pigments;

(7) Quinone imine pigments such as azine pigments, oxazine pigments and thiazine pigments;

(8) Methine pigments such as cyanine pigments and azomethine pigments;

(9) Quinoline pigments;

(10) Nitro pigments

(11) Nitroso pigments

(12) Benzoquinone and naphthoquinone pigments;

(13) Naphthalimide pigments;

(14) Perynone pigments

Among these pigments, azo pigments are preferable in the view of various electrophotographic properties phenomenone such as possibility of selecting several tones, sensitivity, memory or residual potential. Although limited in the use for long wavelength region, phthalocyanines are preferable in electrophotographic properties and are often used in the apparatus in which a semiconductive laser or a LED is used as a light source. For short wavelength region short wave length region, polycyclic quinone pigments are superior to other dyes in anti-oxidation or light resistance, and are suitable for copying machines.

As azo pigment which are used for this invention, following compounds represented by formulae (I)-(V) can be mentioned:

Exemplified Compounds [I]:

X'—N=N—A'—N=N—X'

| Compound No. | —A— | —X' |
|---|---|---|
| I-1 | 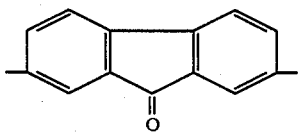 | 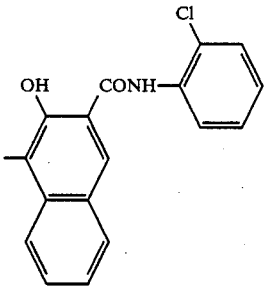 |
| I-2 | " | 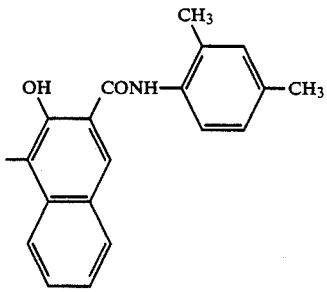 |

-continued
I-3
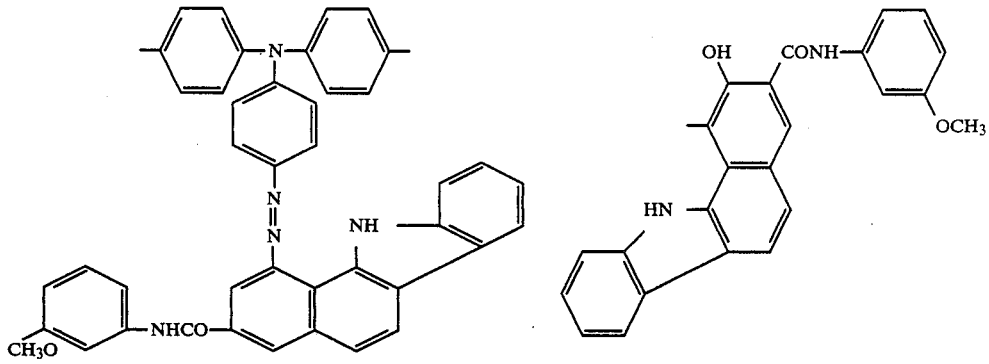
I-4
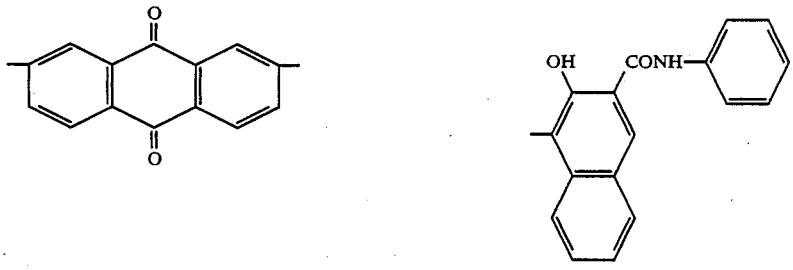
I-5
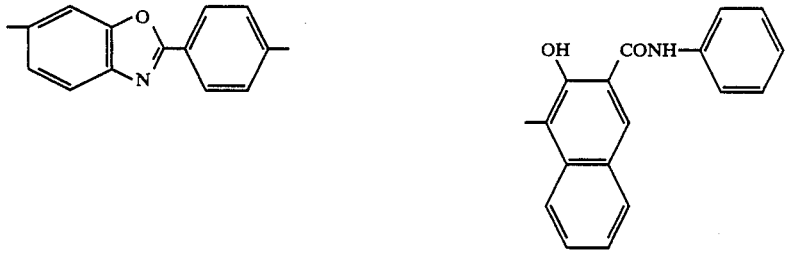
I-6
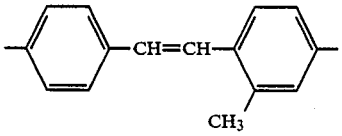
"
I-7
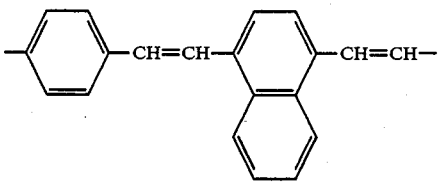
"
I-8
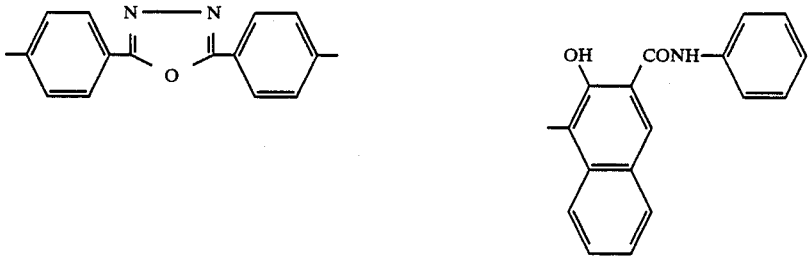
Exemplified Compounds [II];
$X^2-N=N-A^2-N=N-A^3-N=N-X^3$
| Compound No. | $-A^2-$ | $-A^3-$ | $-X^2$, $-X^3$ |
|---|---|---|---|

-continued
| | | | |
|---|---|---|---|
| II-1 | 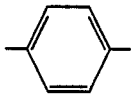 | 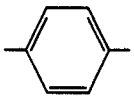 | 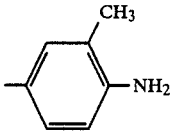  |
| II-2 | " | " | 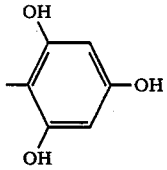  |
| II-3 | " | " | 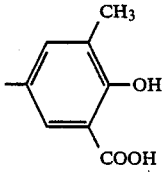  |
| II-4 | " | " | 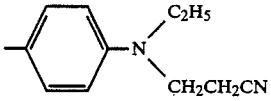  |
| II-5 | " | " | 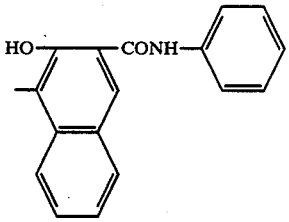  |
| II-6 | " | " | 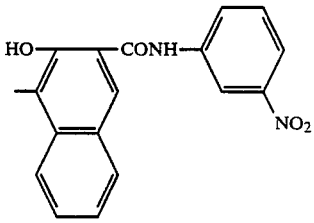  |
| II-7 | " | " | 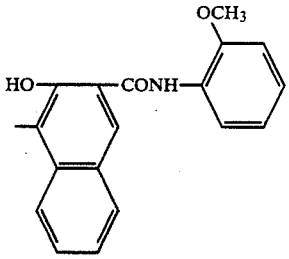  |
| II-8 | 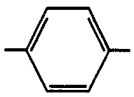 | 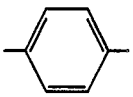 | 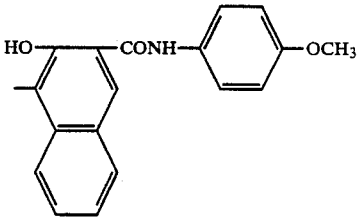  |

-continued
| | | | |
|---|---|---|---|
| II-9 | " | " | 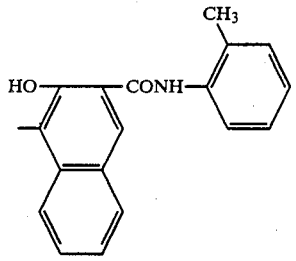 |
| II-10 | " | " | 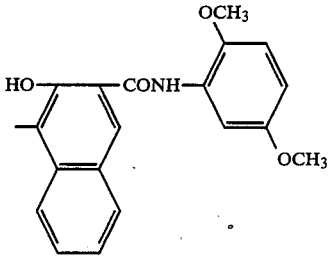 |
| II-11 | " | " | 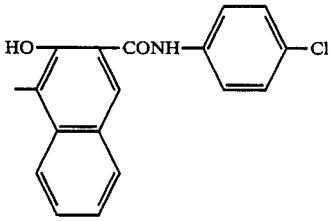 |
| II-12 | " | " | 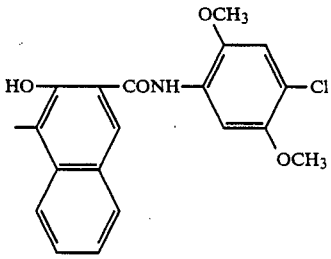 |
| II-13 | 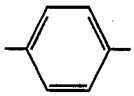 | 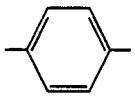 | 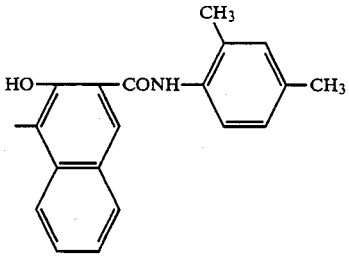 |
| II-14 | " | " | 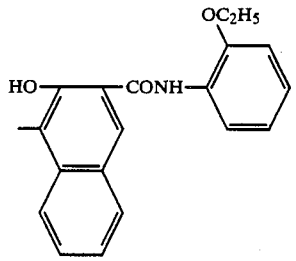 |

-continued
| | | | |
|---|---|---|---|
| II-15 | " | " | 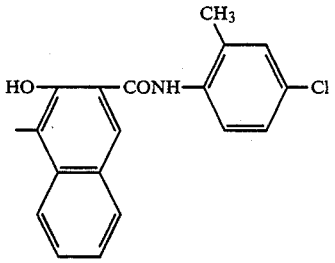 |
| II-16 | " | " | (—$X^2$) 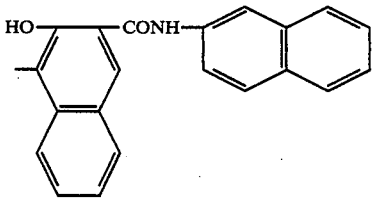 (—$X^3$) 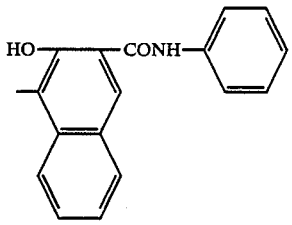 |
| II-17 | 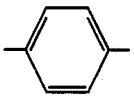 | 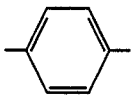 | 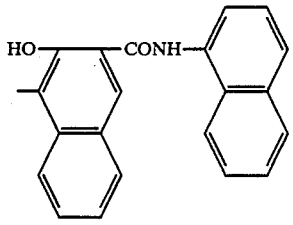 |
| II-18 | " | " | 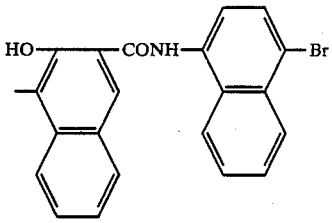 |
| II-19 | " | " | 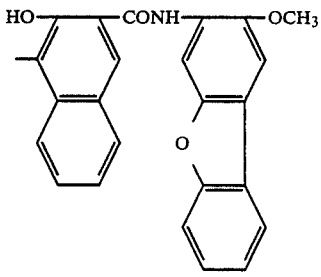 |

-continued
| | | | |
|---|---|---|---|
| II-20 | " | " | 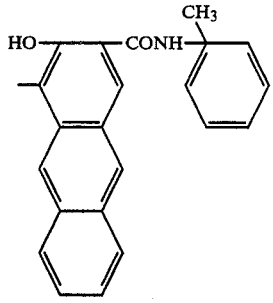 |
| II-21 | " | " | 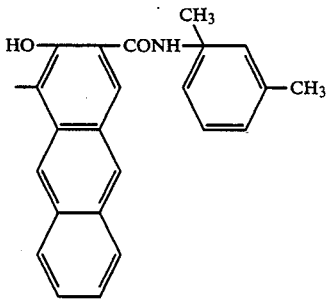 |
| II-22 | 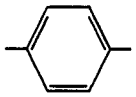 | 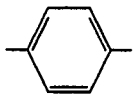 | 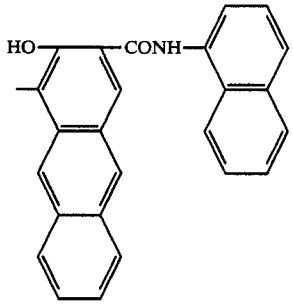 |
| II-23 | " | " | 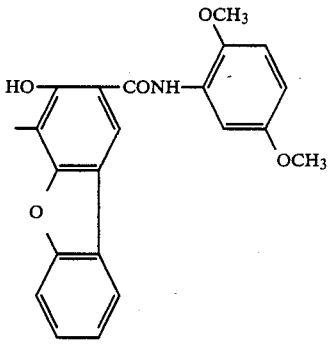 |
| II-24 | " | " | 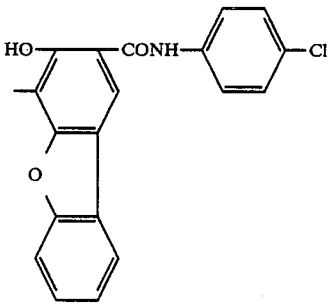 |

-continued
| | | | |
|---|---|---|---|
| II-25 | " | " | 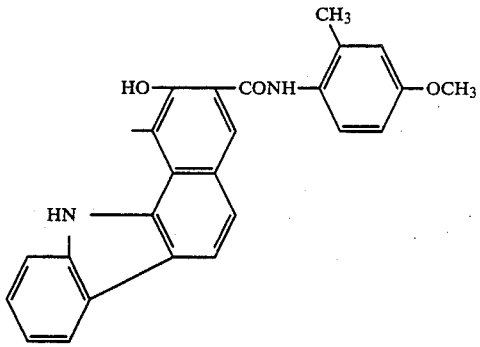 |
| II-26 | " | " | 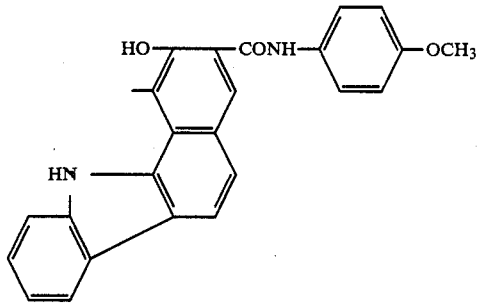 |
| II-27 | 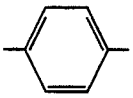 | 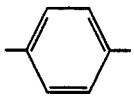 | 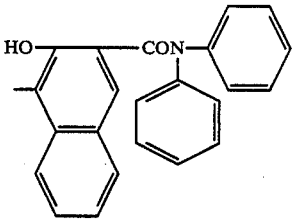 |
| II-28 | " | " | 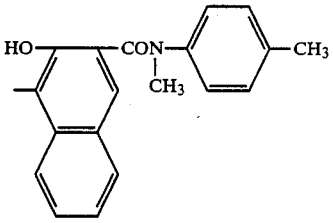 |
| II-29 | " | " | 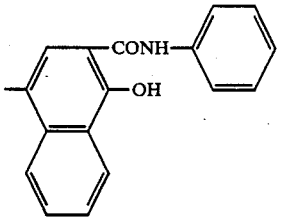 |
| II-30 | " | " | 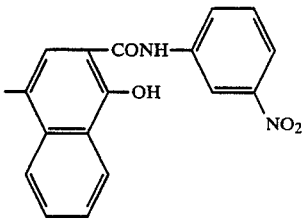 |

-continued
| | | | |
|---|---|---|---|
| II-31 | " | " | 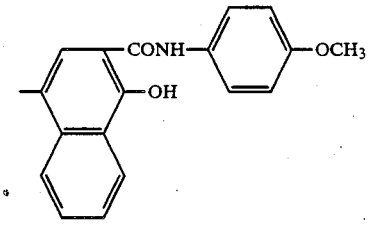 |
| II-32 | 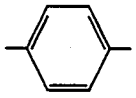 | 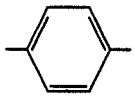 | 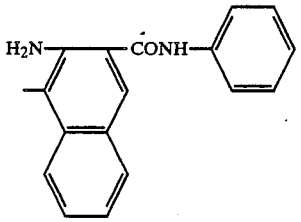 |
| II-33 | " | " | 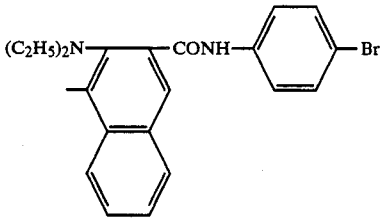 |
| II-34 | " | " | 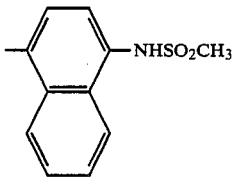 |
| II-35 | " | " | 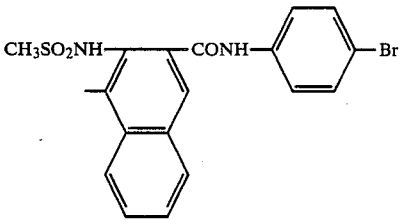 |
| II-36 | " | " | 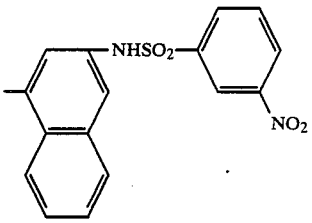 |
| II-37 | 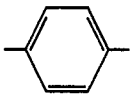 | 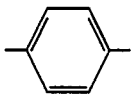 | 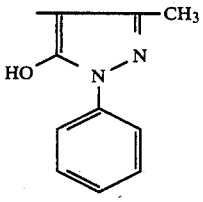 |

-continued
| | | | |
|---|---|---|---|
| II-38 | " | " | 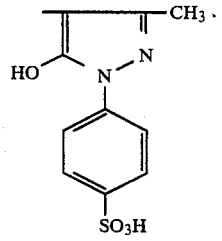 |
| II-39 | " | " | 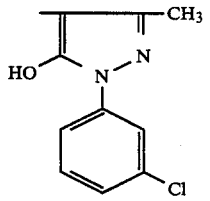 |
| II-40 | " | " | 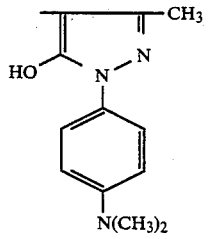 |
| II-41 | " | " | 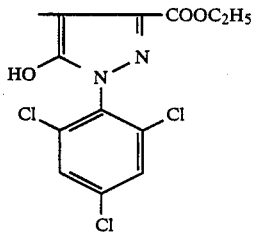 |
| II-42 | 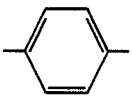 | 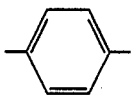 | 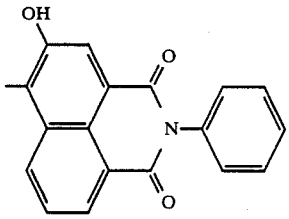 |
| II-43 | " | " | 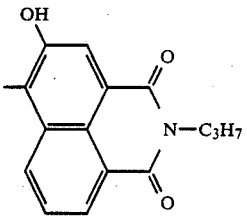 |
| II-44 | " | " | 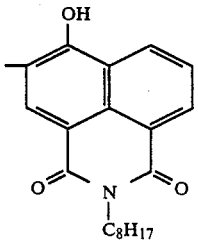 |

-continued
| | | | |
|---|---|---|---|
| II-45 | " | " | 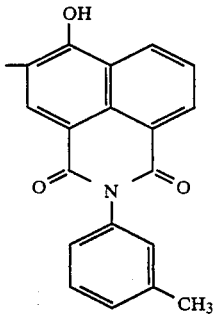 |
| II-46 | 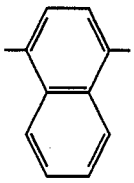 | 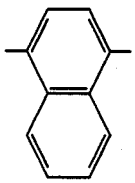 | 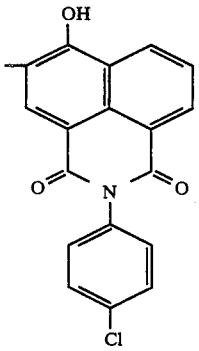 |
| II-47 | 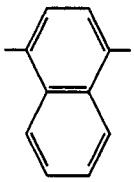 | 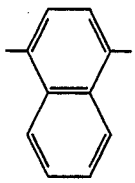 | 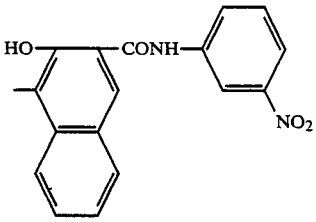 |
| II-48 | " | 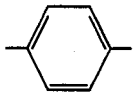 | " |
| II-49 | 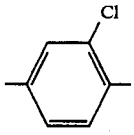 | 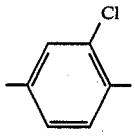 | 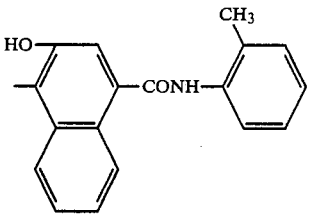 |
| II-50 | 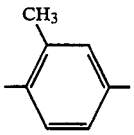 | 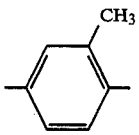 | 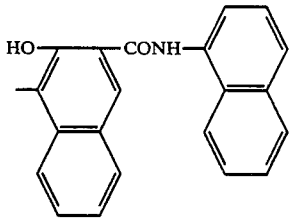 |
| II-51 | 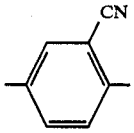 | 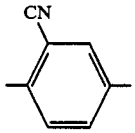 | " |

-continued
| | | | |
|---|---|---|---|
| II-52 | 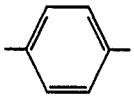 | 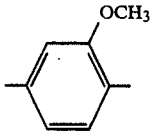 | 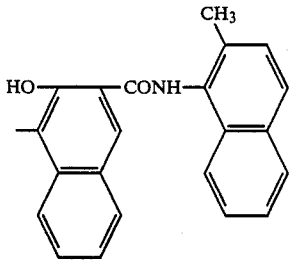 |
| II-53 | " | 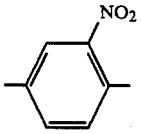 | 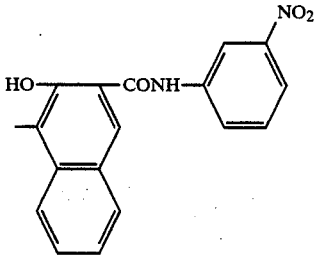 |
| II-54 | 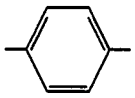 | 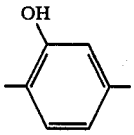 | 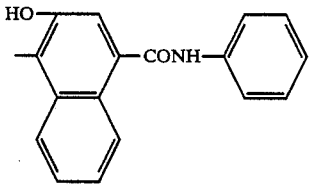 |
| II-55 | 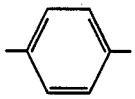 | 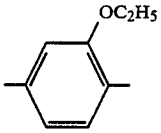 | 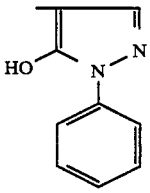 |
| II-56 | 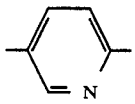 | 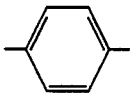 | 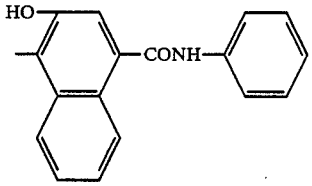 |
| II-57 | 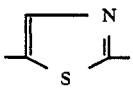 | 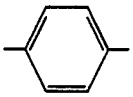 | 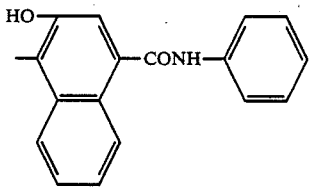 |
| II-58 | 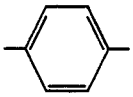 | 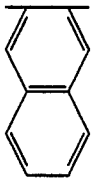 | 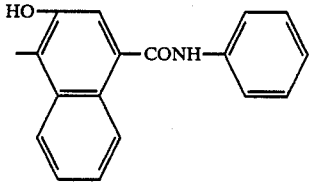 |

-continued
| | | | |
|---|---|---|---|
| II-59 | 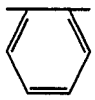 | 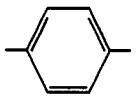 | 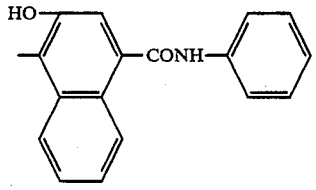 |
| II-60 | 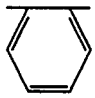 | 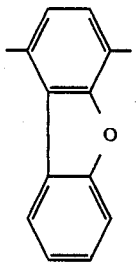 | 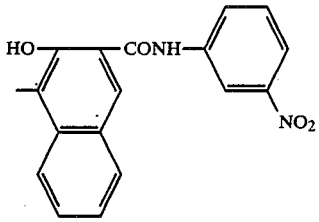 |
| II-61 | 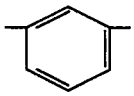 | 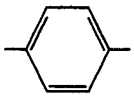 | 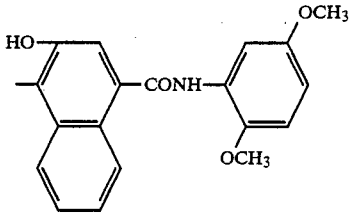 |
| II-62 | 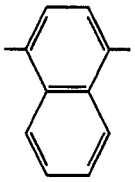 | 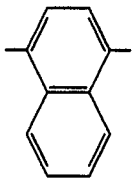 | 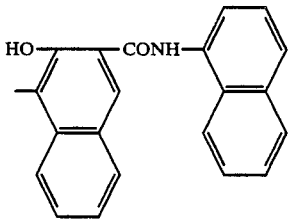 |
| II-63 | 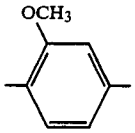 | 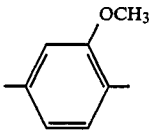 | 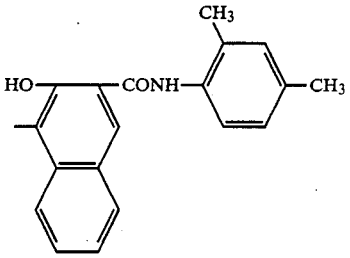 |
| II-64 | 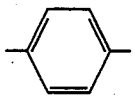 | 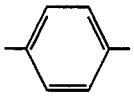 | 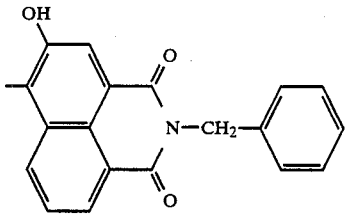 |
Exemplified Compounds [III]:
$X^4—N=N—A^4—N=N—A^5—N=N—A^6—N=N—X^5$
| Compound No. | $—A^4—$ | $—A^5—$ | $—A^6—$ | $—X^4$, $—X^5$ |
|---|---|---|---|---|
| III-1 | 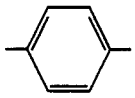 | 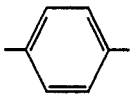 | 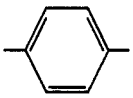 | 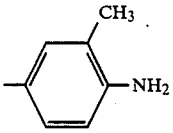 |

-continued
| | | | | |
|---|---|---|---|---|
| III-2 | " | " | " | 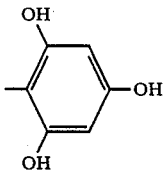 |
| III-3 | " | " | " | 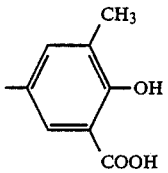 |
| III-4 | " | " | " | 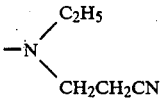 |
| III-5 | " | " | " | 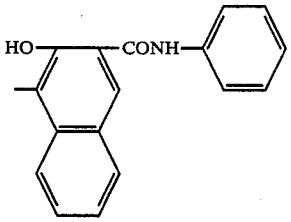 |
| III-6 | " | " | " | 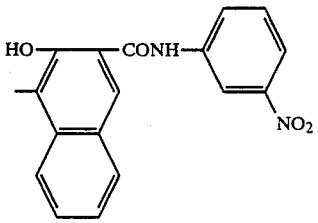 |
| III-7 | 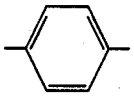 | 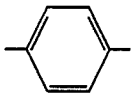 | 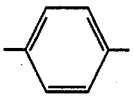 | 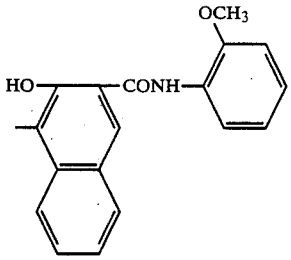 |
| III-8 | " | " | " | 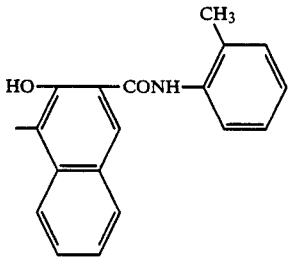 |

-continued
| | | | | |
|---|---|---|---|---|
| III-9 | " | " | " | 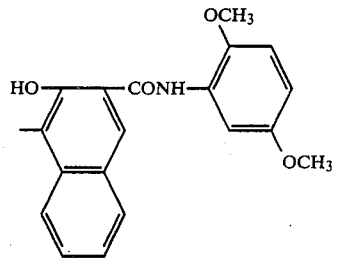 |
| III-10 | " | " | " | 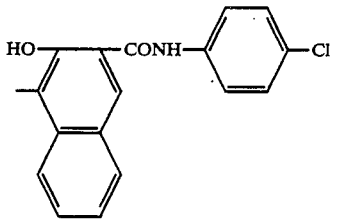 |
| III-11 | " | " | " | 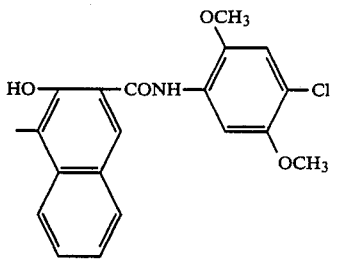 |
| III-12 | 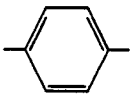 | 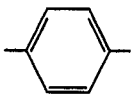 | 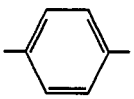 | 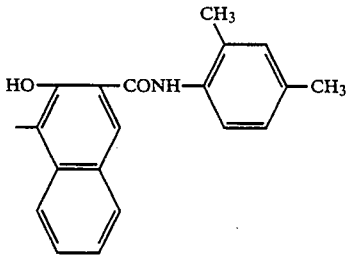 |
| III-13 | " | " | " | 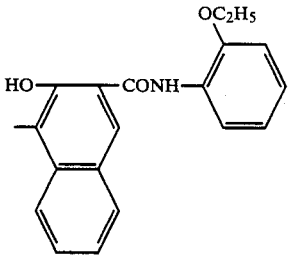 |
| III-14 | " | " | " | 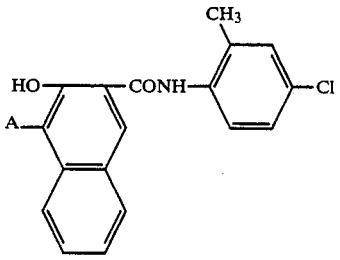 |

-continued
| | | | | |
|---|---|---|---|---|
| III-15 | " | " | " | 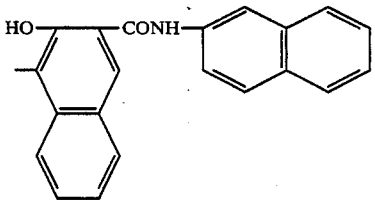 |
| III-16 | " | " | " | 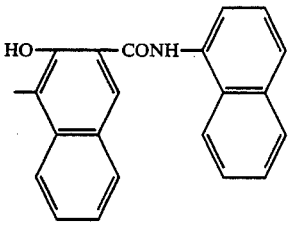 |
| III-17 | 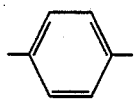 | 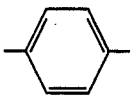 | 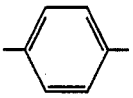 | 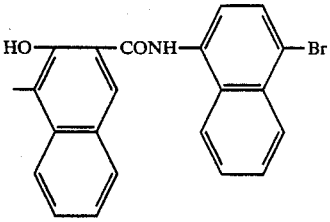 |
| III-18 | " | " | " | 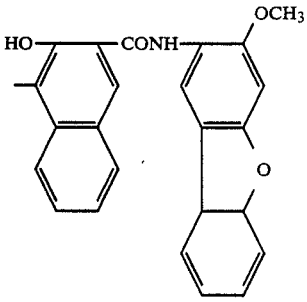 |
| III-19 | " | " | " | 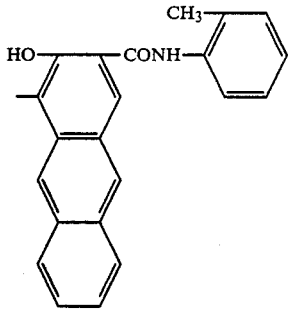 |
| III-20 | " | " | " | 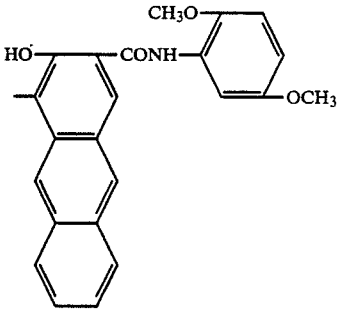 |

-continued
| | | | | |
|---|---|---|---|---|
| III-21 | " | " | " | 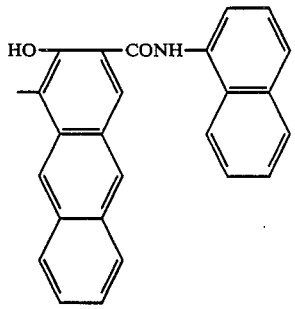 |
| III-22 | 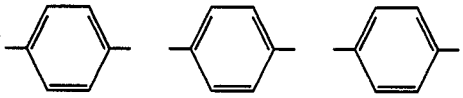 | | | 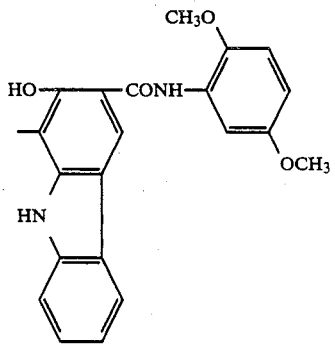 |
| III-23 | " | " | " | 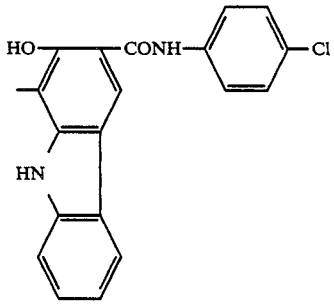 |
| III-24 | " | " | " | 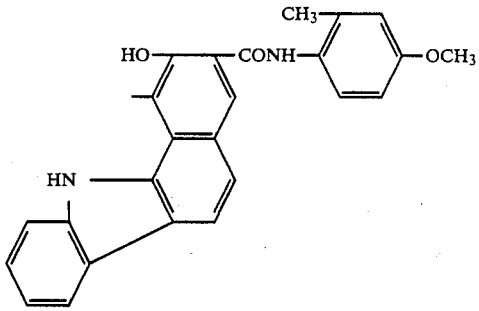 |
| III-25 | " | " | " | 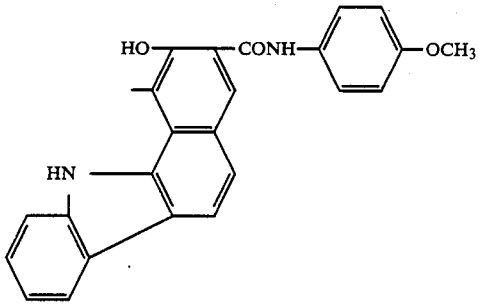 |

-continued
| | | | | |
|---|---|---|---|---|
| III-26 | " | " | " | 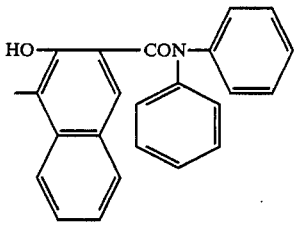 |
| III-27 | 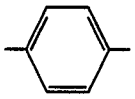 | 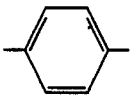 | 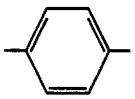 | 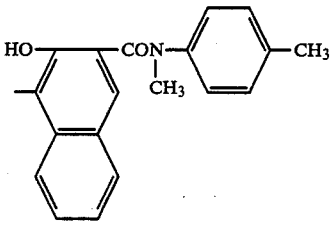 |
| III-28 | " | " | " | 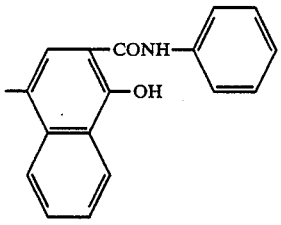 |
| III-29 | " | " | " | 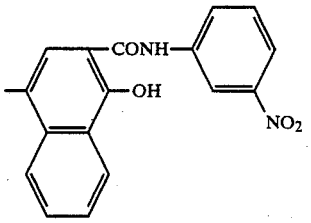 |
| III-30 | " | " | " | 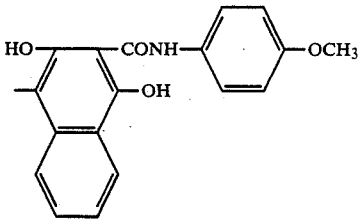 |
| III-31 | " | " | " | 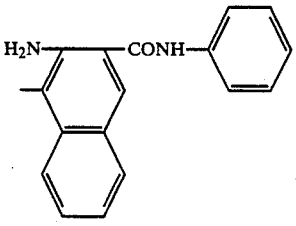 |

-continued
| | | | | |
|---|---|---|---|---|
| III-32 | 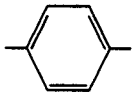 | 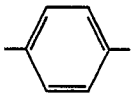 | 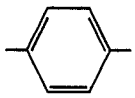 | 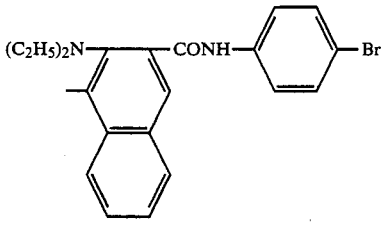 |
| III-33 | " | " | " | 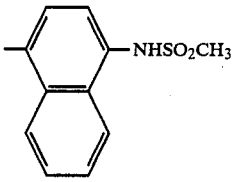 |
| III-34 | " | " | " | 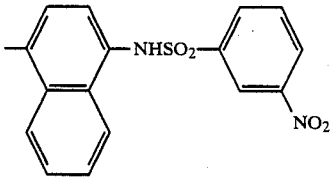 |
| III-35 | " | " | " | 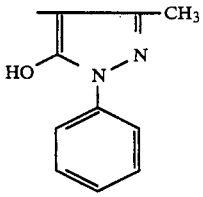 |
| III-36 | " | " | " | 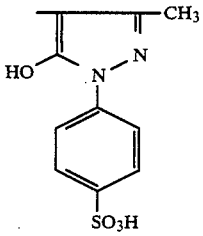 |
Following exemplified compounds group (VI)–(VII) which consists of polycyclicquinone pigments is most preferable to use as CGM.
Exemplified Compounds [VI]:
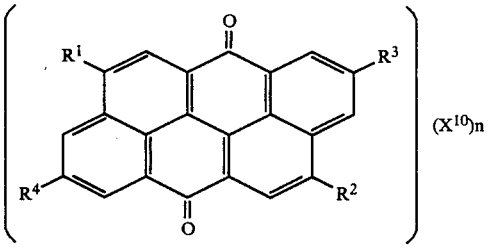
| Compound No. | $R^1$ | $R^2$ | $R^3$ | $R^4$ | $X^{10}$ | n |
|---|---|---|---|---|---|---|
| VI-1 | — | — | — | — | — | 0 |
| VI-2 | Cl | Cl | — | — | — | 0 |
| VI-3 | Br | Br | — | — | — | 0 |
| VI-4 | — | — | Br | Br | — | 0 |
| VI-5 | Br | Br | Br | Br | — | 0 |
| VI-6 | — | — | — | — | I | 2 |
| VI-7 | — | — | — | — | " | 3 |
| VI-8 | — | — | — | — | " | 4 |
| VI-9 | — | — | — | — | $NO_2$ | 2 |
| VI-10 | — | — | — | — | CN | 2 |
| VI-11 | — | — | — | — | $COCH_3$ | 2 |
Exemplified Compounds [VII]:
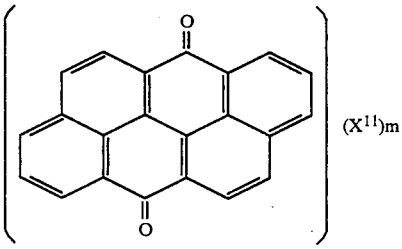

-continued

| Compound No. | $X^{11}$ | m |
|---|---|---|
| VII-1 | — | 0 |
| VII-2 | Cl | 2 |
| VII-3 | Br | 2 |
| VII-4 | I | 2 |
| VII-5 | I | 3 |
| VII-6 | I | 4 |
| VII-7 | $NO_2$ | 2 |
| VII-8 | CN | 2 |
| VII-9 | $COC_6H_5$ | 2 |

Exemplified Compounds [VIII]:

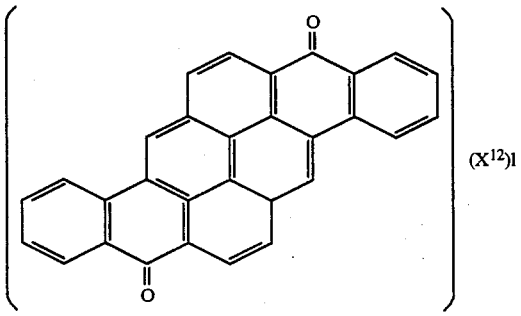

| Compound No. | $X^{12}$ | l |
|---|---|---|
| VIII-1 | — | 0 |
| VIII-2 | Cl | 2 |
| VIII-3 | Br | 2 |
| VIII-4 | " | 3 |
| VIII-5 | " | 4 |
| VIII-6 | I | 4 |
| VIII-7 | $NO_2$ | 3 |
| VIII-8 | CN | 4 |
| VIII-9 | $COCH_3$ | 4 |

Next, as charge transporting material which is applicable to use in this invention, there is specially no limitation. Applicable examples are as follows:

Oxazole derivative, oxadiazole derivative, thiazole derivative, thiadiazole derivative, triazole derivative, immidazole derivative, imidazole derivative, imidazolone derivative, imidazolidine derivative, bisimidazolidine derivative, styryl compound, hydrazone compound, pyrazoline derivative, oxazolone derivative, benzothiazole derivative, benzimidazole derivative quinazoline derivative, benzofuran derivative, acridine derivative, phenazine derivative, aminostilbene derivative, poly-N-vinylcarbazole, poly-1-vinylpyrene, poly-9-vinylanthracene, etc,.

To use the CTM which has exceeding transporting ability to supporting material of hole which is produced by irradiation. Also, using CTM which is preferable to combine with forgoing carrier producing material, and as such CTM, the styryl compound which represents following exemplified compound groups (IX) OR groups (X).

Exemplified Compounds [IX]:

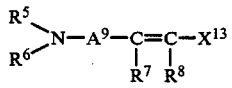

| Compound No. | $-R^5$ | $-R^6$ | $-R^7$ | $-R^8$ | $-A^9-$ | $-X^{13}$ |
|---|---|---|---|---|---|---|
| IX-1 | 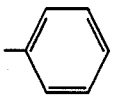 | 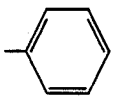 | —H | 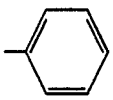 | 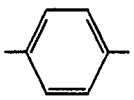 | 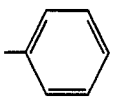 |
| IX-2 | 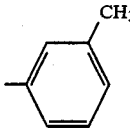 | " | " | " | " | 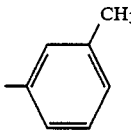 |
| IX-3 | 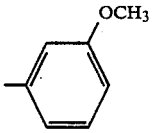 | " | " | " | " | 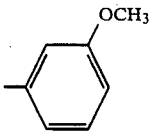 |
| IX-4 | $-CH_3$ | $-CH_3$ | " | —H | " | 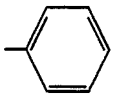 |
| IX-5 | $-C_2H_5$ | $-C_2H_5$ | " | " | " | " |
| IX-6 | " | " | " | " | " | 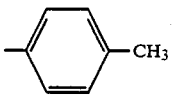 |

-continued
| | | | | | | |
|---|---|---|---|---|---|---|
| IX-7 | " | " | " | " | " | 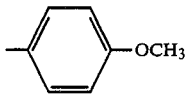 |
| IX-8 | 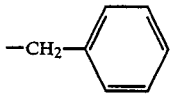 | 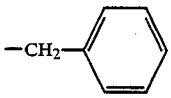 | " | " | " | 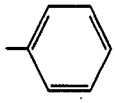 |
| IX-9 | 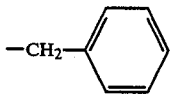 | 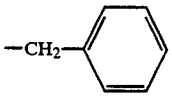 | —H | 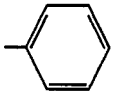 | 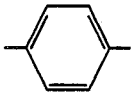 | 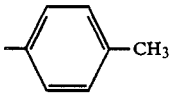 |
| IX-10 | " | " | " | " | " | 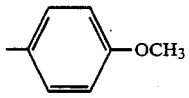 |
| IX-11 | " | " | —H | —H | 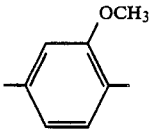 | 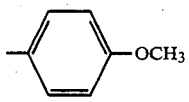 |
| IX-12 | $-C_2H_5$ | " | " | " | 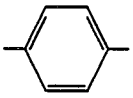 | " |
| IX-13 | 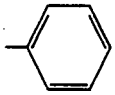 | 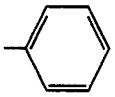 | " | " | " | 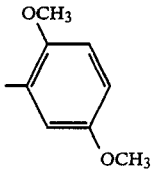 |
| IX-14 | " | " | " | " | " | 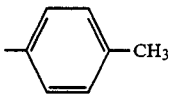 |
| IX-15 | " | " | " | " | " | 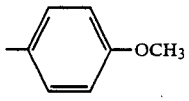 |
| IX-16 | " | " | " | " | " | 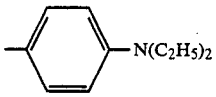 |
| IX-17 | " | " | " | " | " | 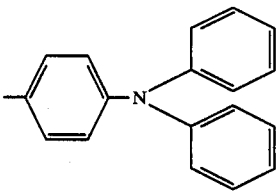 |
| IX-18 | " | " | " | " | 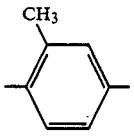 | 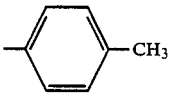 |

-continued
| | | | | | | |
|---|---|---|---|---|---|---|
| IX-19 | 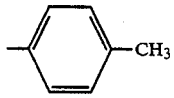 | 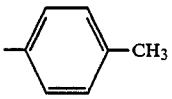 | —H | —H | 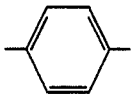 | 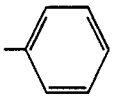 |
| IX-20 | " | " | " | " | " | 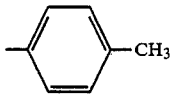 |
| IX-21 | " | " | —H | —H | 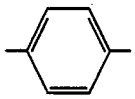 | 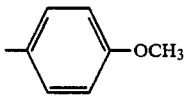 |
| IX-22 | " | " | —H | —H | 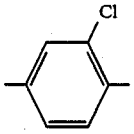 | 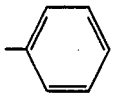 |
| IX-23 | " | " | " | " | 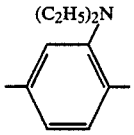 | 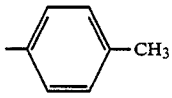 |
| IX-24 | 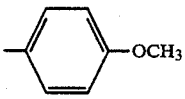 | 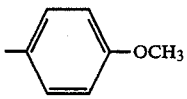 | " | " | 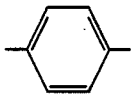 | 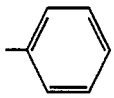 |
| IX-25 | " | " | " | " | " | 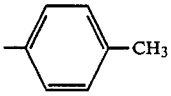 |
| IX-26 | " | " | " | " | " | 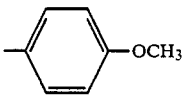 |
| IX-27 | " | " | " | " | 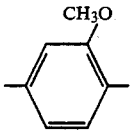 | 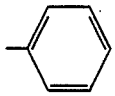 |
| IX-28 | $-C_2H_5$ | $-C_2H_5$ | " | " | 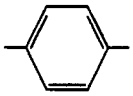 | 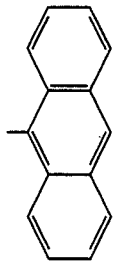 |

-continued
| | | | | | | |
|---|---|---|---|---|---|---|
| IX-29 | 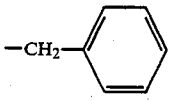 | 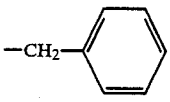 | —H | —H | 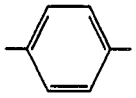 | 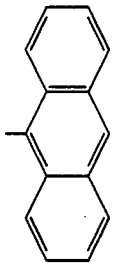 |
| IX-30 | " | " | " | " | 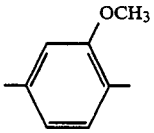 | " |
| IX-31 | 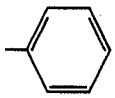 | 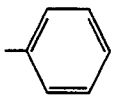 | " | " | 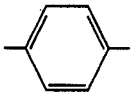 | 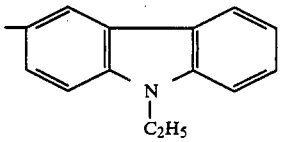 |
| IX-32 | " | " | " | " | 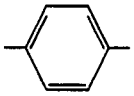 | 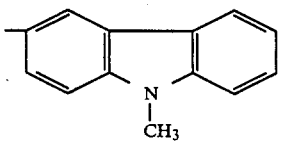 |
| IX-33 | 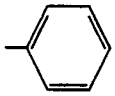 | 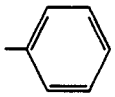 | —H | —H | 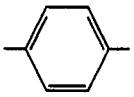 | 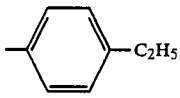 |
| IX-34 | " | " | " | " | " | 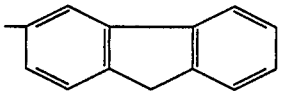 |
| IX-35 | 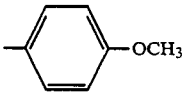 | " | " | " | " | 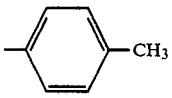 |
| IX-36 | " | " | " | " | " | 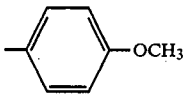 |
| IX-37 | 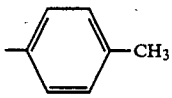 | " | " | " | " | " |
| IX-38 | 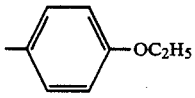 | " | " | " | " | 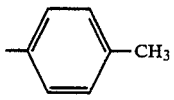 |
| IX-39 | 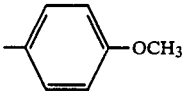 | 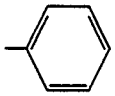 | —H | —H | 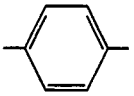 | 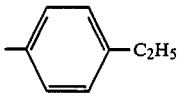 |

-continued
| | | | | | |
|---|---|---|---|---|---|
| IX-40 | " | " | " | " | " | 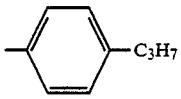 |
| IX-41 | " | " | " | " | " | 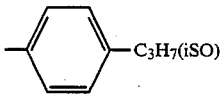 |
| IX-42 | " | " | " | " | " | 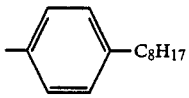 |
| IX-43 | " | " | " | " | " | 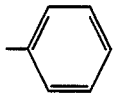 |
| IX-44 | " | " | " | " | " | 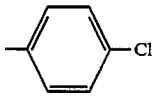 |
| IX-45 | " | " | " | " | " | 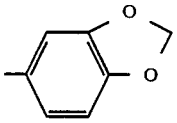 |
| IX-46 | " | " | " | " | " | 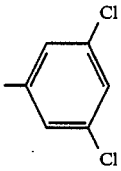 |
| IX-47 | " | " | " | " | " | 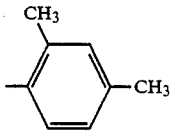 |
| IX-48 | " | " | " | " | " | 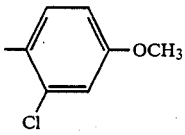 |
| IX-49 | 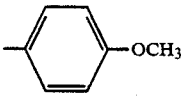 | 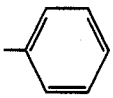 | —H | —H | 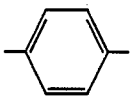 | 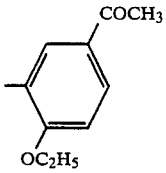 |
| IX-50 | " | " | " | " | " | 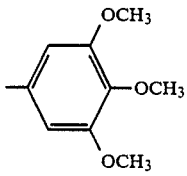 |

-continued
| | | | | | | |
|---|---|---|---|---|---|---|
| IX-51 | " | " | " | " | " | 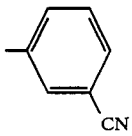 |
| IX-52 | " | " | " | " | " | 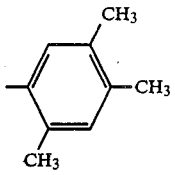 |
| IX-53 | " | " | " | " | " | 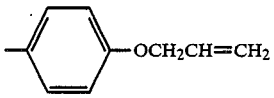 |
| IX-54 | 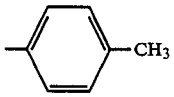 | " | " | " | " | 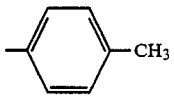 |
| IX-55 | " | " | " | " | " | 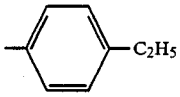 |
| IX-56 | " | " | " | " | " | 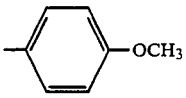 |
| IX-57 | " | " | " | " | " | 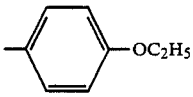 |
| IX-58 | " | " | " | " | " | 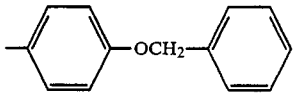 |
| IX-59 | 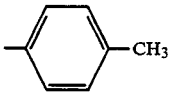 | 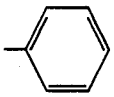 | —H | —H | 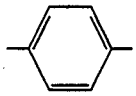 | 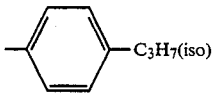 |
| IX-60 | " | " | " | " | " | 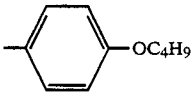 |
| IX-61 | " | " | " | " | " | 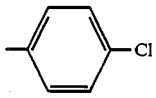 |
| IX-62 | " | " | " | " | " | 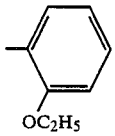 |

-continued
| | | | | | | |
|---|---|---|---|---|---|---|
| IX-63 | " | " | " | " | " | 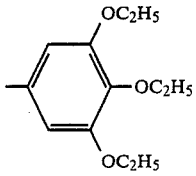 |
| IX-64 | " | " | " | " | " | 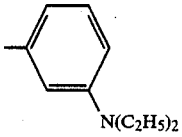 |
| IX-65 | " | " | " | " | " | 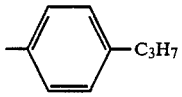 |
| IX-66 | 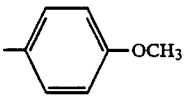 | 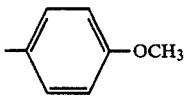 | —H | —H | " | 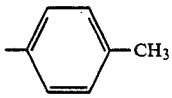 |
| IX-67 | " | 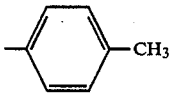 | " | " | " | 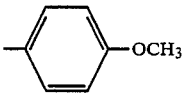 |
| IX-68 | " | " | " | " | " | 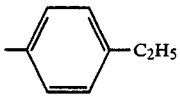 |
| IX-69 | 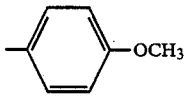 | 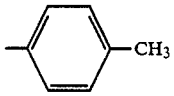 | H | H | 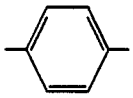 | 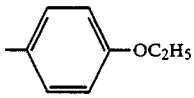 |
| IX-70 | " | " | " | " | " | 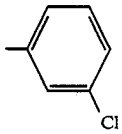 |
| IX-71 | " | " | " | " | " | 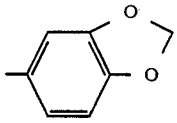 |
| IX-72 | " | " | " | " | 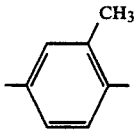 | 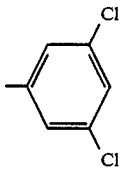 |
| IX-73 | " | " | " | " | 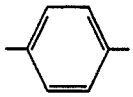 | 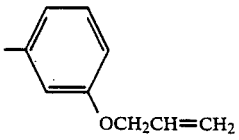 |

-continued
| | | | | | | |
|---|---|---|---|---|---|---|
| IX-74 | 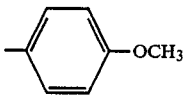 | 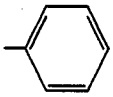 | " | " | " | 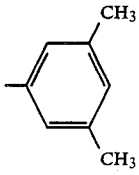 |
| IX-75 | 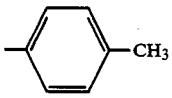 | " | " | " | " | " |
| IX-76 | 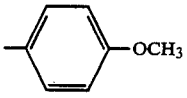 | 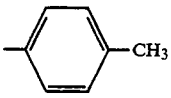 | " | " | " | " |
| IX-77 | 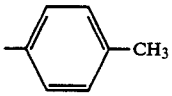 | 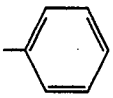 | —H | —H | " | 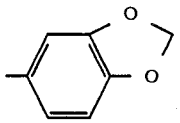 |
| IX-78 | 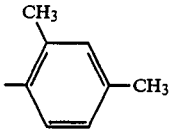 | " | —$CH_3$ | " | " | 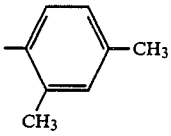 |
| IX-79 | 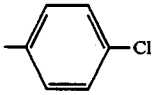 | 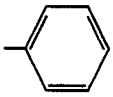 | —$CH_3$ | —H | 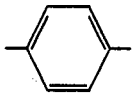 | 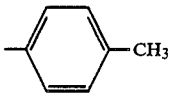 |
| IX-80 | 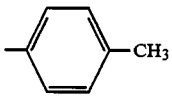 | 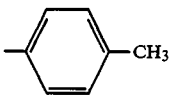 | —H | —$CH_3$ | " | 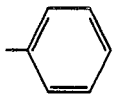 |
| IX-81 | 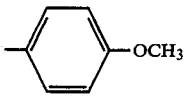 | 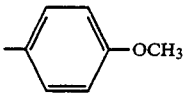 | " | " | " | 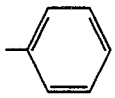 |
Exemplified Compounds [X]:
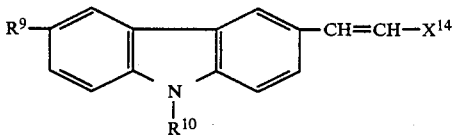
| Compound No. | —$R^9$ | —$R^{10}$ | —$X^{14}$ |
|---|---|---|---|
| X-1 | —H | 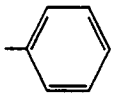 | 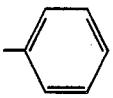 |
| X-2 | " | " | 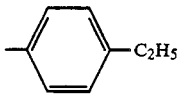 |
| X-3 | " | " | 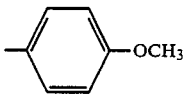 |

-continued
| | | | |
|---|---|---|---|
| X-4 | " | " | 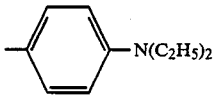 |
| X-5 | —H | 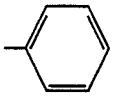 | 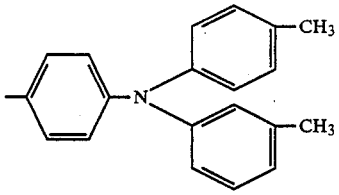 |
| X-6 | " | 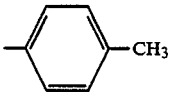 | 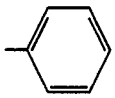 |
| X-7 | " | " | 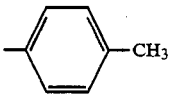 |
| X-8 | " | " | 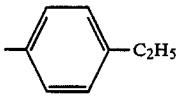 |
| X-9 | " | " | 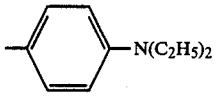 |
| X-10 | " | " | 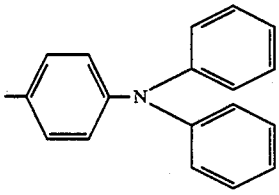 |
| X-11 | " | 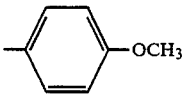 | 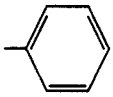 |
| X-12 | " | " | 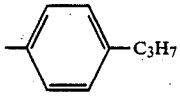 |
| X-13 | " | 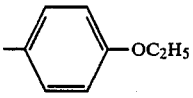 | 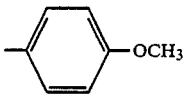 |
| X-14 | —H | 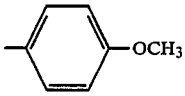 | 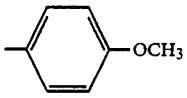 |
| X-15 | " | " | 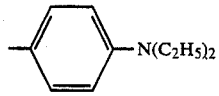 |

-continued
| | | | |
|---|---|---|---|
| X-16 | " | " | 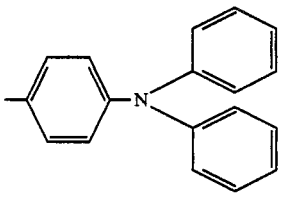 |
| X-17 | " | 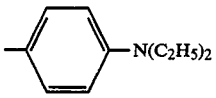 | 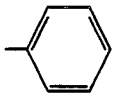 |
| X-18 | " | " | 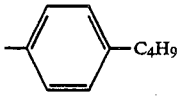 |
| X-19 | " | 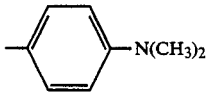 | 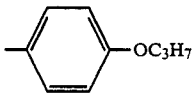 |
| X-20 | " | 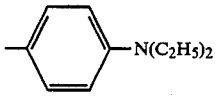 | 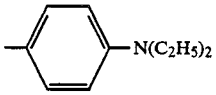 |
| X-21 | " | 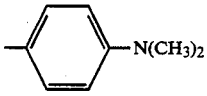 | 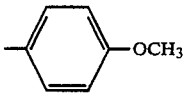 |
| X-22 | —Cl | 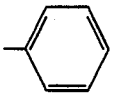 | 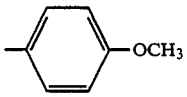 |
| X-23 | —$OCH_3$ | 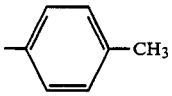 | 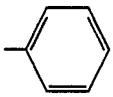 |
| X-24 | —OH | 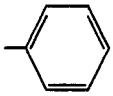 | 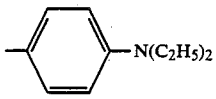 |
| X-25 | —$N(C_2H_5)_2$ | 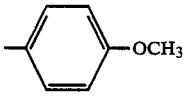 | 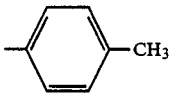 |
| X-26 | —H | 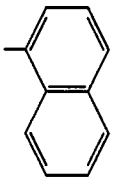 | 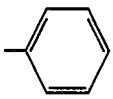 |

-continued
| | | | |
|---|---|---|---|
| X-27 | " | 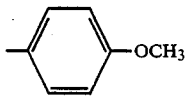 | 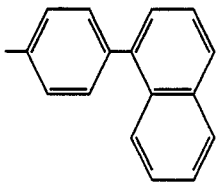 |
| X-28 | " | 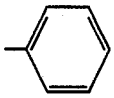 | 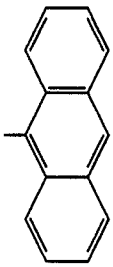 |
| X-29 | " | " | 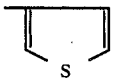 |
| X-30 | " | 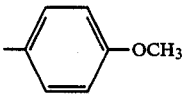 | 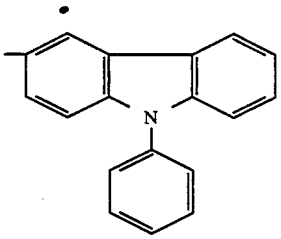 |
| X-31 | $-OCH_3$ | " | 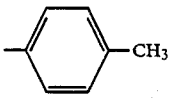 |
| X-32 | $-OCH_3$ | 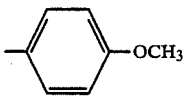 | 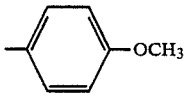 |
| X-33 | " | " | 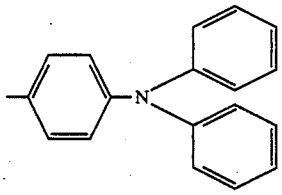 |
Hydrazone compound, which represents following exemplified compounds (XI)–(XV) as CTR, is also applicable to use.
Exemplified Compounds [XI]:
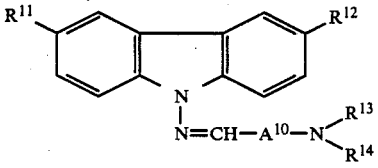
| Compound No. | $-R^{11}$ | $-R^{12}$ | $-R^{13}$ | $-R^{14}$ | $-A^{10}-$ |
|---|---|---|---|---|---|

-continued
| | | | | | |
|---|---|---|---|---|---|
| XI-1 | —H | —H | 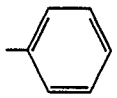 | 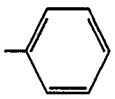 | 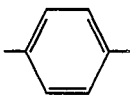 |
| XI-2 | " | " | 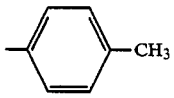 | 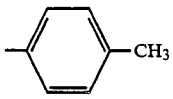 | " |
| XI-3 | " | " | " | 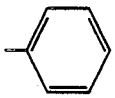 | " |
| XI-4 | —H | —H | 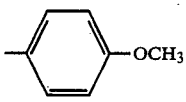 | 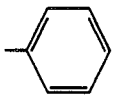 | 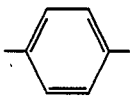 |
| XI-5 | " | " | " | 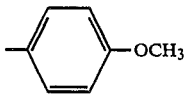 | " |
| XI-6 | " | —Cl | 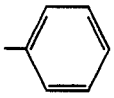 | 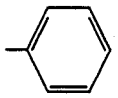 | " |
| XI-7 | " | " | 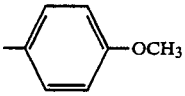 | 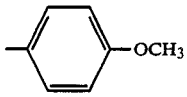 | " |
| XI-8 | " | " | 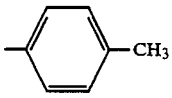 | 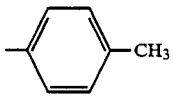 | " |
| XI-9 | " | —H | 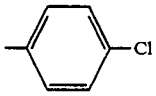 | 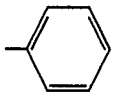 | " |
| XI-10 | " | " | 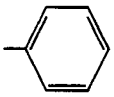 | " | 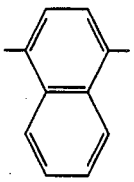 |
| XI-11 | " | " | 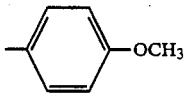 | 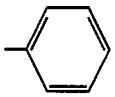 | 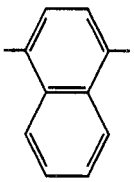 |
| XI-12 | " | " | 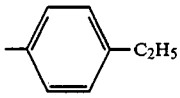 | " | 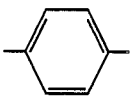 |

-continued
| | | | | | |
|---|---|---|---|---|---|
| XI-13 | " | " | 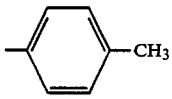 | 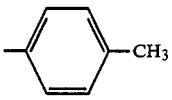 | " |
| XI-14 | " | —Cl | 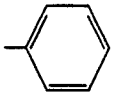 | 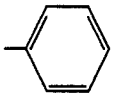 | 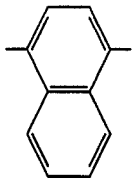 |
Exemplified Compounds [XII]:
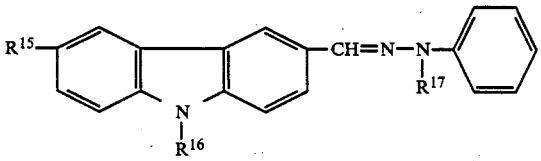
| Compound No. | $-R^{15}$ | $-R^{16}$ | $-R^{17}$ |
|---|---|---|---|
| XII-1 | —H | $-CH_3$ | $-CH_3$ |
| XII-2 | " | " | $-C_2H_5$ |
| XII-3 | " | " | 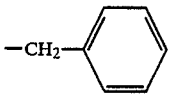 |
| XII-4 | " | " | 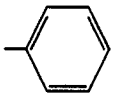 |
| XII-5 | " | $-C_2H_5$ | $-CH_3$ |
| XII-6 | " | " | $-C_2H_5$ |
| XII-7 | " | " | 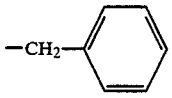 |
| XII-8 | " | " | 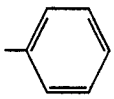 |
| XII-9 | " | $-CH_2CH_2OH$ | $-CH_3$ |
| XII-10 | " | " | $-C_2H_5$ |
| XII-11 | " | " | 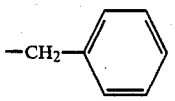 |
| XII-12 | —Cl | " | " |
Exemplified Compounds [XIII]:
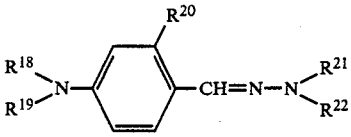
| Compound No. | $-R^{18}$ | $-R^{19}$ | $-R^{20}$ | $-R^{21}$ | $-R^{22}$ |
|---|---|---|---|---|---|
| XIII-1 | $-C_2H_5$ | $-C_2H_5$ | —H | 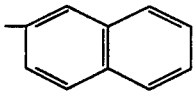 | 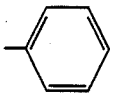 |

-continued
| | | | | | |
|---|---|---|---|---|---|
| XIII-2 | " | " | " | 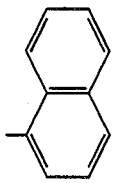 | " |
| XIII-3 | " | " | " | " | 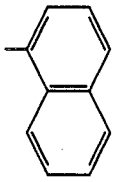 |
| XIII-4 | " | " | " | 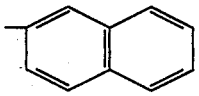 | 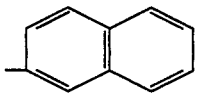 |
| XIII-5 | " | " | " | " | 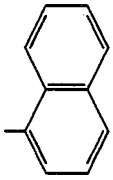 |
| XIII-6 | $-C_3H_7$ | $-C_3H_7$ | " | 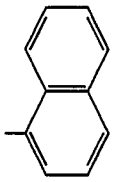 | 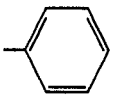 |
| XIII-7 | $-C_4H_9$ | $-C_4H_9$ | " | 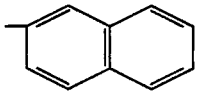 | " |
| XIII-8 | 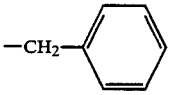 | 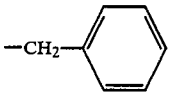 | " | 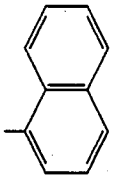 | " |
| XIII-9 | 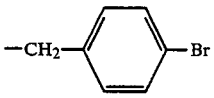 | 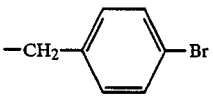 | $-H$ | 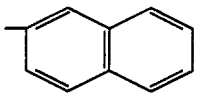 | 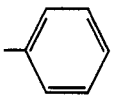 |
| XIII-10 | 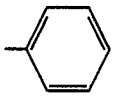 | 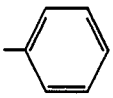 | " | 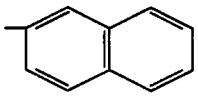 | " |
| XIII-11 | $-C_2H_5$ | $-(CH_2)_2N(CH_3)_2$ | " | " | 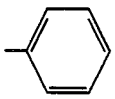 |
| XIII-12 | " | $-CH_2CH_2OCH_3$ | " | " | " |

-continued
| | | | | | |
|---|---|---|---|---|---|
| XIII-13 | " | $-C_2H_5$ | $-CH_3$ | 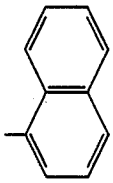 | " |
| XIII-14 | " | " | $-OCH_3$ | " | " |
| XIII-15 | " | " | $-OC_4H_9$ | " | " |
| XIII-16 | 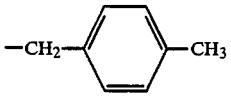 | 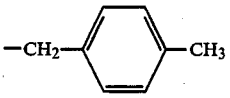 | $-H$ | " | " |
| XIII-17 | $-C_2H_5$ | $-C_2H_5$ | " | 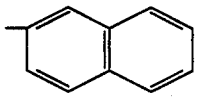 | 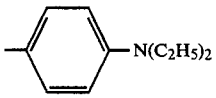 |
| XIII-18 | " | " | " | " | 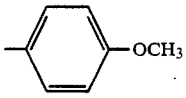 |
| XIII-19 | $-C_2H_5$ | $-CH_2CH_2Cl$ | $-H$ | 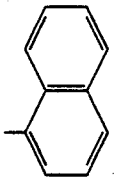 | 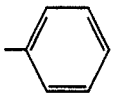 |
| XIII-20 | " | $-C_2H_5$ | " | 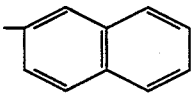 | 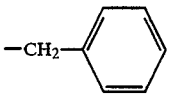 |
| XIII-21 | " | " | " | " | $-C_2H_5$ |
| XIII-22 | $-C_3H_7$ | $-C_3H_7$ | " | 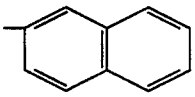 | 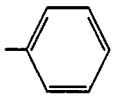 |
Exemplified Compounds [XIV]:
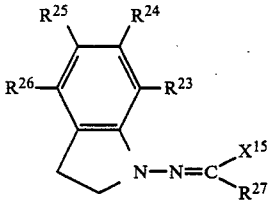
| Compound No. | $-R^{23}$ | $-R^{24}$ | $-R^{25}$ | $-R^{26}$ | $-R^{27}$ | $-X^{15}$ |
|---|---|---|---|---|---|---|
| XIV-1 | $-H$ | $-H$ | $-H$ | $-H$ | $-H$ | 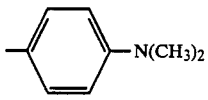 |
| XIV-2 | " | " | " | " | " | 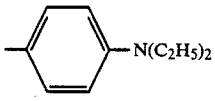 |

-continued
| | | | | | | |
|---|---|---|---|---|---|---|
| XIV-3 | " | " | " | " | " | 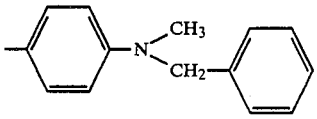 |
| XIV-4 | —H | —H | —$CH_3$ | —H | —H | 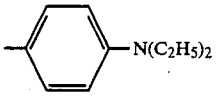 |
| XIV-5 | " | " | —H | " | " | 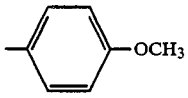 |
| XIV-6 | " | " | —$OCH_3$ | " | " | 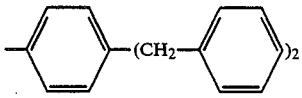 |
| XIV-7 | " | " | —H | " | " | 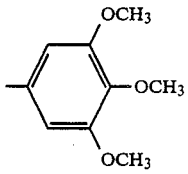 |
| XIV-8 | " | " | " | " | " | 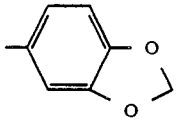 |
| XIV-9 | " | " | " | " | " | 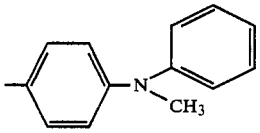 |
| XIV-10 | " | " | " | " | " | 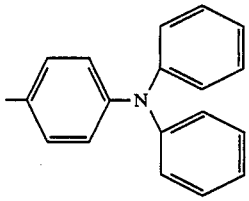 |
| XIV-11 | " | —$CH_3$ | " | " | " | " |
| XIV-12 | " | —H | " | " | " | 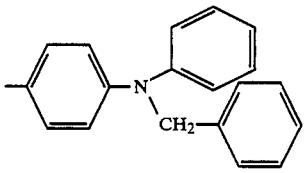 |
| XIV-13 | —H | —H | —H | —H | —H | 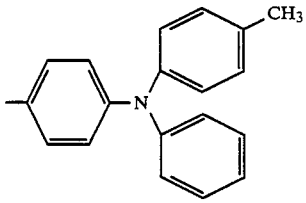 |

-continued
| | | | | | | |
|---|---|---|---|---|---|---|
| XIV-14 | " | " | " | " | " | 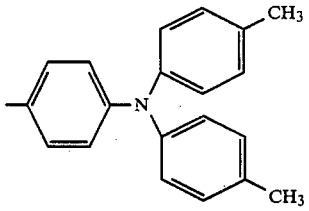 |
| XIV-15 | " | " | " | " | " | 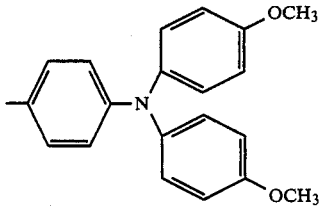 |
| XIV-16 | " | —OCH$_3$ | " | " | " | 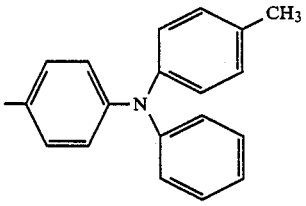 |
| XIV-17 | " | —H | " | —Cl | " | 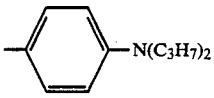 |
| XIV-18 | —C$_2$H$_5$ | " | " | —H | —CH$_3$ | 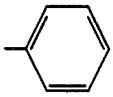 |
| XIV-19 | —H | " | " | " | 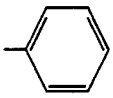 | 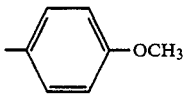 |
| XIV-20 | " | " | " | " | —C$_2$H$_5$ | 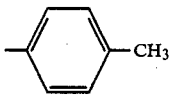 |
| XIV-21 | " | " | " | " | 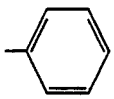 | 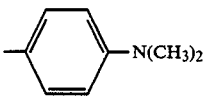 |
| XIV-22 | —H | —H | —H | —H | —CH$_3$ | 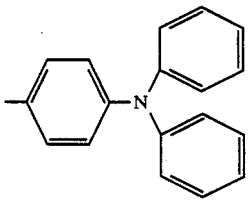 |

-continued
| | | | | | | |
|---|---|---|---|---|---|---|
| XIV-23 | " | " | " | " | —H | 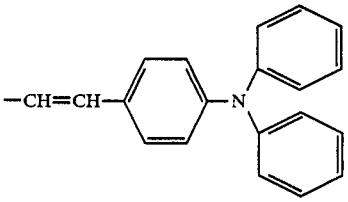 |
| XIV-24 | " | " | " | " | " | 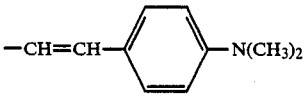 |
| XIV-25 | " | " | " | " | " | 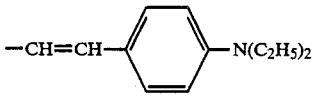 |
| XIV-26 | " | " | " | " | " | 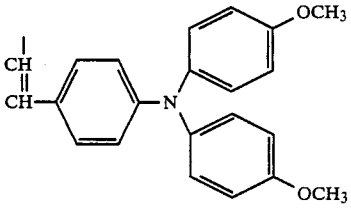 |
| XIV-27 | " | " | " | " | —$CH_3$ | 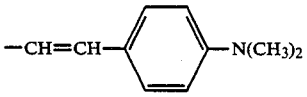 |
| XIV-28 | " | " | " | " | " | 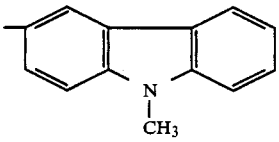 |
| XIV-29 | " | " | " | " | " | 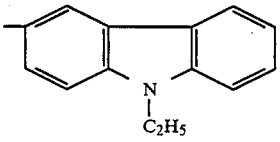 |
| XIV-30 | —H | —H | —H | —H | —H | 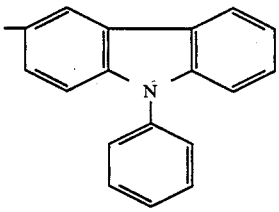 |
| XIV-31 | " | " | " | " | " | 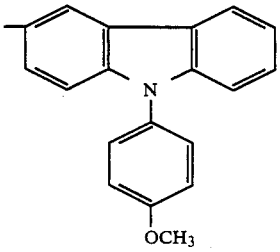 |

-continued
| | | | | | | |
|---|---|---|---|---|---|---|
| XIV-32 | " | " | " | " | " | 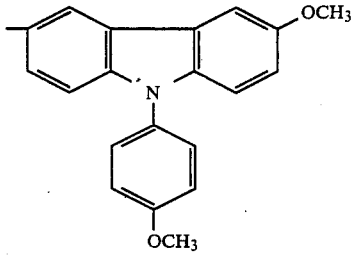 |
| XIV-33 | " | " | $-CH_3$ | " | " | 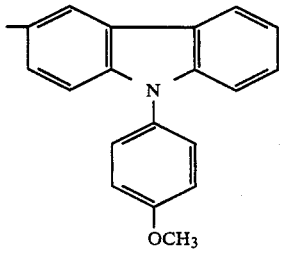 |
| XIV-34 | " | " | " | " | " | 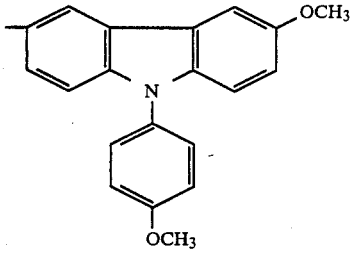 |
| XIV-35 | " | " | $-H$ | " | " | 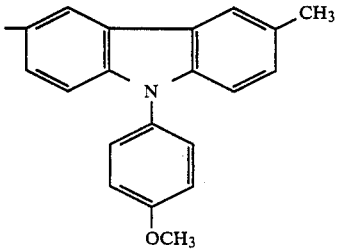 |
| XIV-36 | $-H$ | $-CH_3$ | $-H$ | $-H$ | $-H$ | 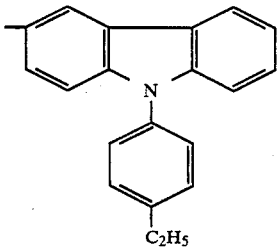 |
| XIV-37 | " | $-H$ | " | " | " | 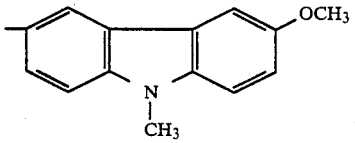 |

-continued
| | | | | | | |
|---|---|---|---|---|---|---|
| XIV-38 | " | " | " | " | " | 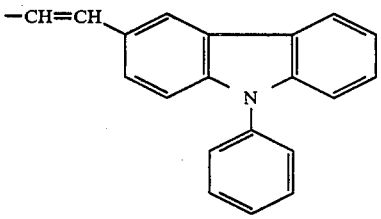 |
| XIV-39 | " | " | " | " | " | 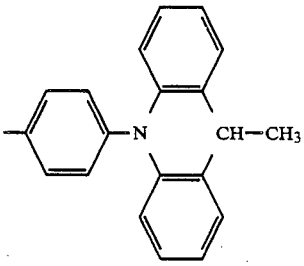 |
| XIV-40 | $-N(CH_3)_2$ | " | " | " | " | 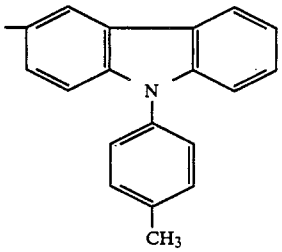 |
| XIV-41 | —H | —H | —H | —H | —H | 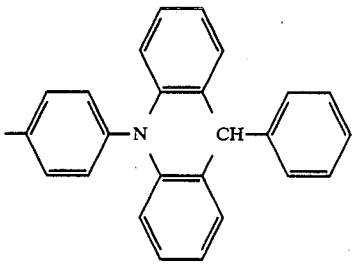 |
| XIV-42 | " | " | " | " | " | 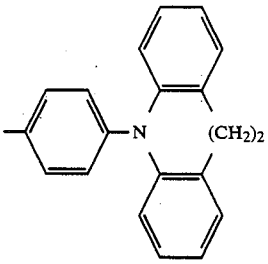 |
| XIV-43 | " | " | " | " | " | 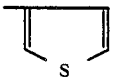 |
| XIV-44 | " | " | " | " | " | 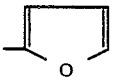 |

-continued
| | | | | | |
|---|---|---|---|---|---|
| XIV-45 | " | " | " | " | " 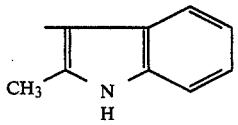 |
| XIV-46 | " | " | " | " | " 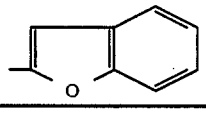 |
Exemplified Compounds [XV]:
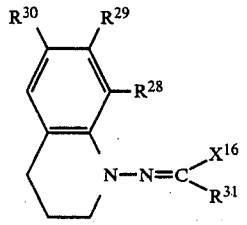
| Compound No. | $-R^{28}$ | $-R^{29}$ | $-R^{30}$ | $-R^{31}$ | $-X^{16}$ |
|---|---|---|---|---|---|
| XV-1 | —H | —H | —H | —H | 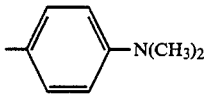 |
| XV-2 | " | " | " | " | 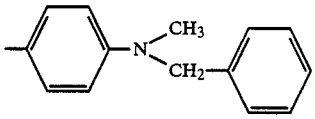 |
| XV-3 | " | " | $-CH_3$ | —H | 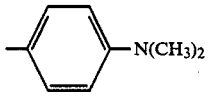 |
| XV-4 | " | " | —H | " | " |
| XV-5 | " | " | " | " | 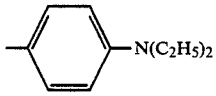 |
| XV-6 | " | $-OCH_3$ | " | " | " |
| XV-7 | " | —H | " | " | 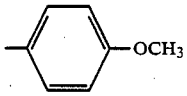 |
| XV-8 | " | " | " | " | 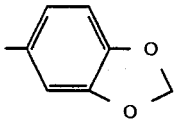 |
| XV-9 | —H | —H | —H | —H | 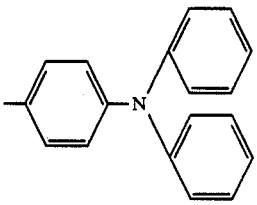 |

-continued
| | | | | | |
|---|---|---|---|---|---|
| XV-10 | " | " | " | " | 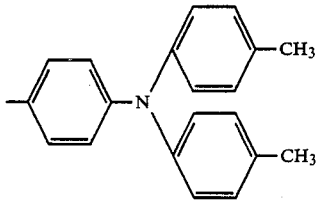 |
| XV-11 | " | " | " | " | 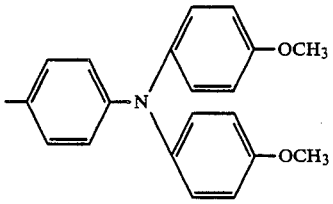 |
| XV-12 | " | " | $-CH_3$ | " | 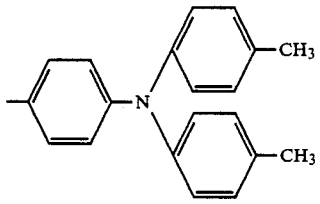 |
| XV-13 | " | " | $-OCH_3$ | " | 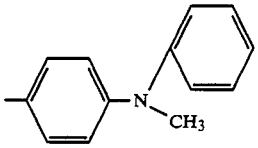 |
| XV-14 | " | " | $-Cl$ | " | 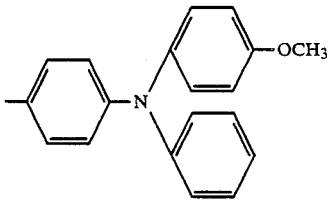 |
| XV-15 | " | - | $-H$ | 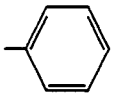 | 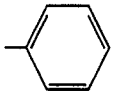 |
| XV-16 | " | " | " | " | 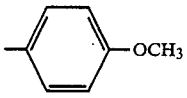 |
| XV-17 | $-H$ | $-H$ | $-H$ | $-CH_3$ | 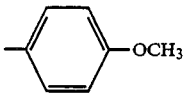 |
| XV-18 | " | " | " | " | 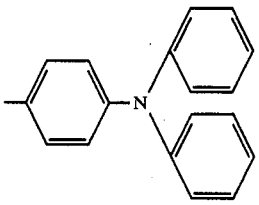 |

-continued
| | | | | | |
|---|---|---|---|---|---|
| XV-19 | " | " | " | 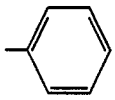 | 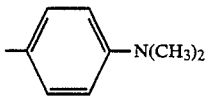 |
| XV-20 | " | " | " | —H | 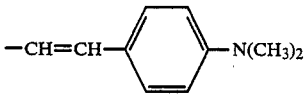 |
| XV-21 | " | " | " | " | 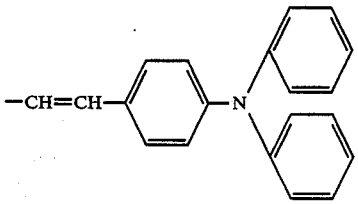 |
| XV-22 | —$CH_3$ | " | " | " | 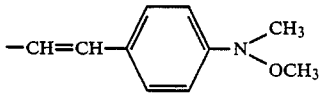 |
| XV-23 | —H | " | " | —$CH_3$ | 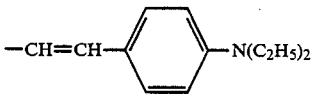 |
| XV-24 | " | " | " | —H | 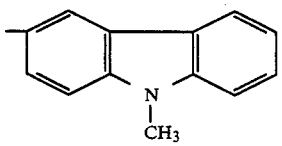 |
| XV-25 | " | " | " | " | 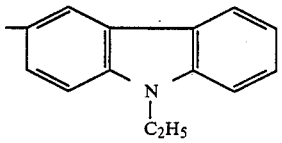 |
| XV-26 | —H | —H | —H | —H | 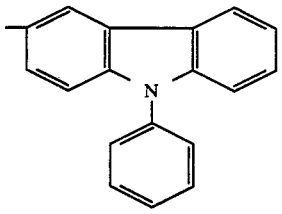 |
| XV-27 | " | " | —$CH_3$ | " | 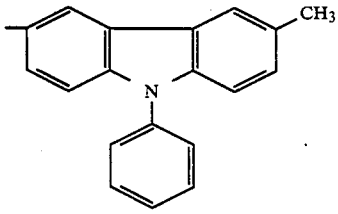 |

-continued
| | | | | | |
|---|---|---|---|---|---|
| XV-28 | " | " | —H | " | 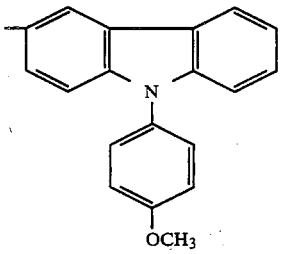 |
| XV-29 | " | " | —$CH_3$ | " | 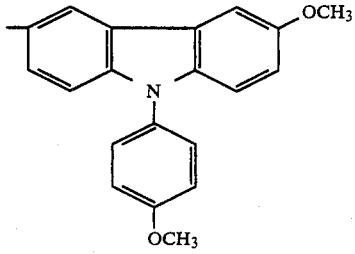 |
| XV-30 | " | " | —H | " | 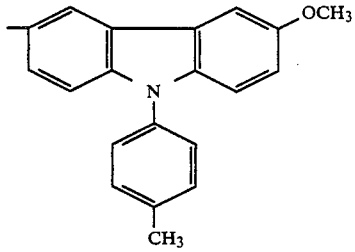 |
| XV-31 | " | " | " | " | 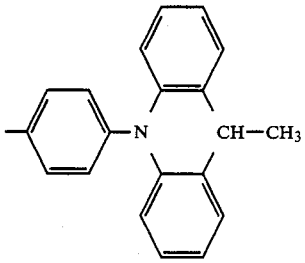 |
| XV-32 | —H | —H | —H | —H | 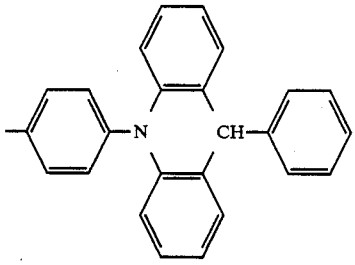 |
| XV-33 | " | " | " | " | 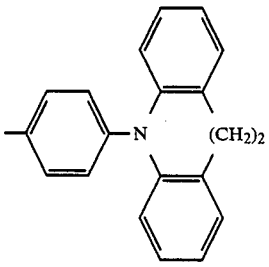 |

-continued
| | | | | | |
|---|---|---|---|---|---|
| XV-34 | " | " | " | " | 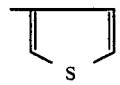 |
| XV-35 | " | " | —CN | " | 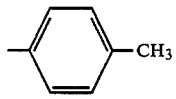 |
| XV-36 | " | $-N(C_2H_5)_2$ | —H | " | 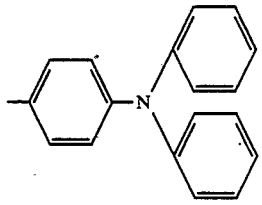 |
| XV-37 | $-C_2H_5$ | —H | " | " | 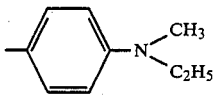 |
| XV-38 | —H | " | " | " | 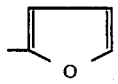 |
| XV-39 | —H | —H | —H | —H | 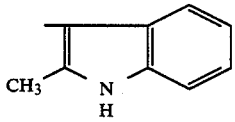 |
| XV-40 | " | " | " | " | 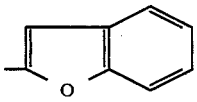 |
| XV-41 | " | " | " | " | 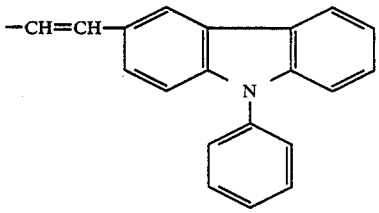 |
| XV-42 | $-C_3H_7$ | " | " | $-CH_3$ | 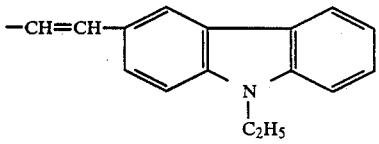 |
| | | | | |
|---|---|---|---|---|
| III-37 | 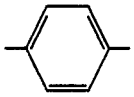 | 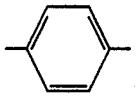 | 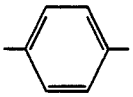 | 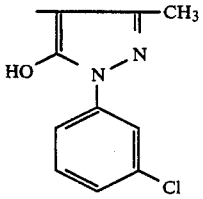 |

-continued
| | | | | |
|---|---|---|---|---|
| III-38 | " | " | " | 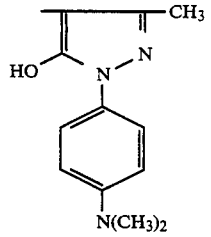 |
| III-39 | " | " | " | 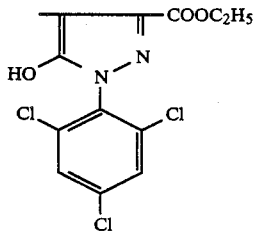 |
| III-40 | " | " | " | 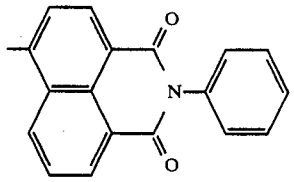 |
| III-41 | " | " | " | 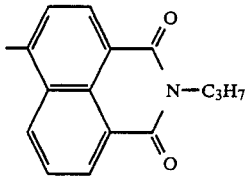 |
| III-42 | " | " | " | 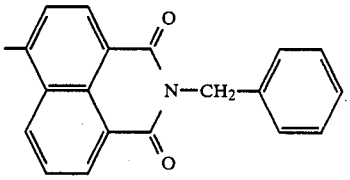 |
| III-43 | " | " | " | 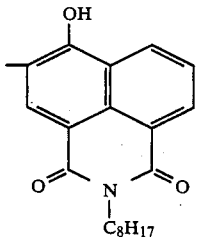 |
| III-44 | " | " | " | 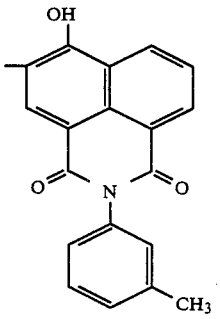 |

-continued
| | | | | |
|---|---|---|---|---|
| III-45 | " | " | " | 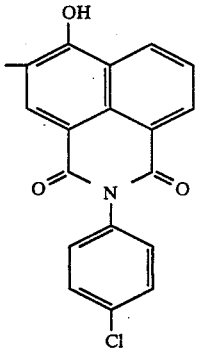 |
| III-46 | " | " | " | 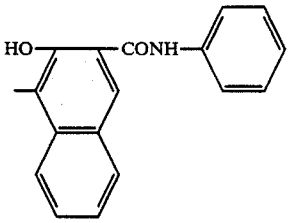 |
| III-47 | 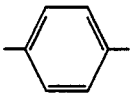 | 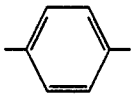 | 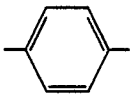 | 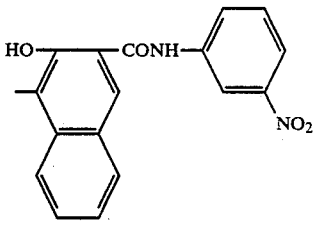 |
| III-48 | 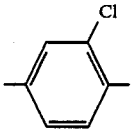 | " | 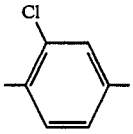 | 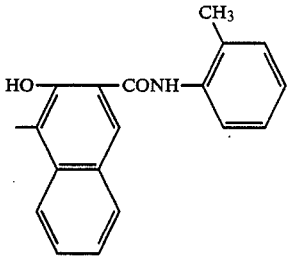 |
| III-49 | 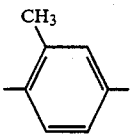 | " | 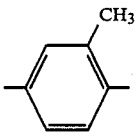 | 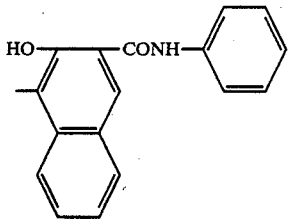 |
| III-50 | 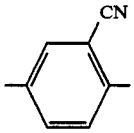 | " | 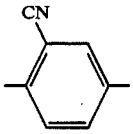 | 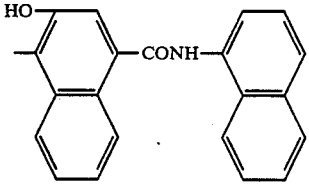 |

-continued
| | | | | |
|---|---|---|---|---|
| III-51 | 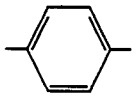 | " | 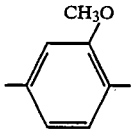 | 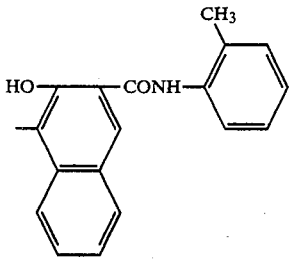 |
| III-52 | 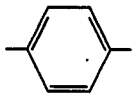 | 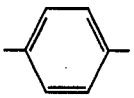 | 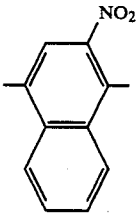 | 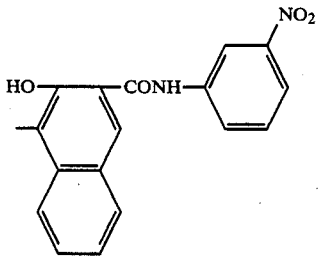 |
| III-53 | " | " | 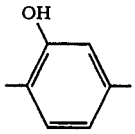 | 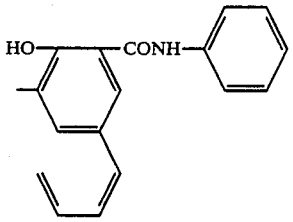 |
| III-54 | " | " | 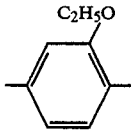 | 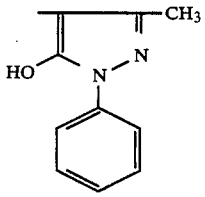 |
| III-55 | 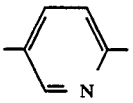 | " | 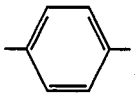 | 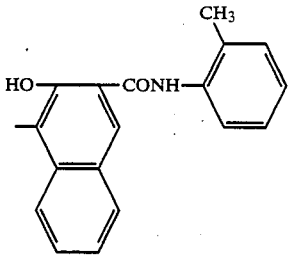 |
| III-56 | 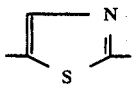 | " | " | 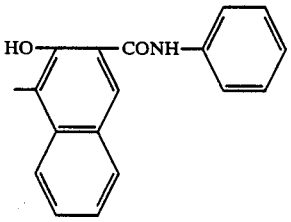 |

-continued
III-57
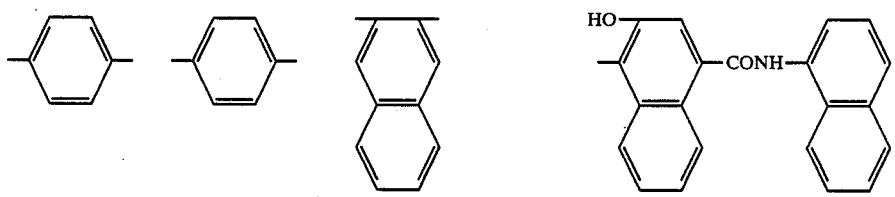
III-58
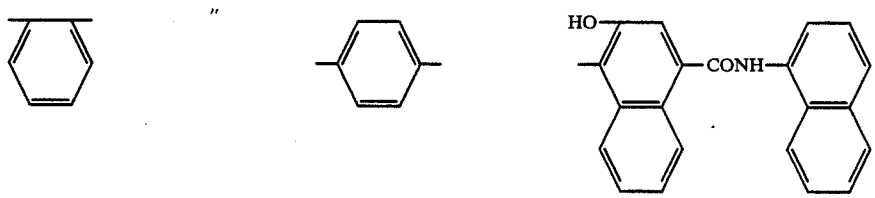
III-59
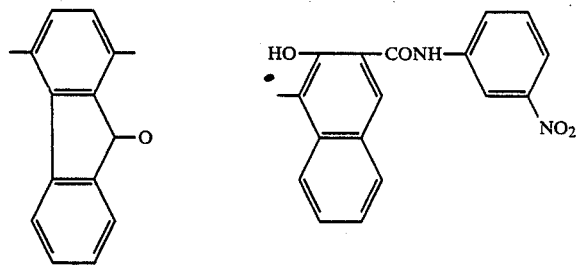
III-60
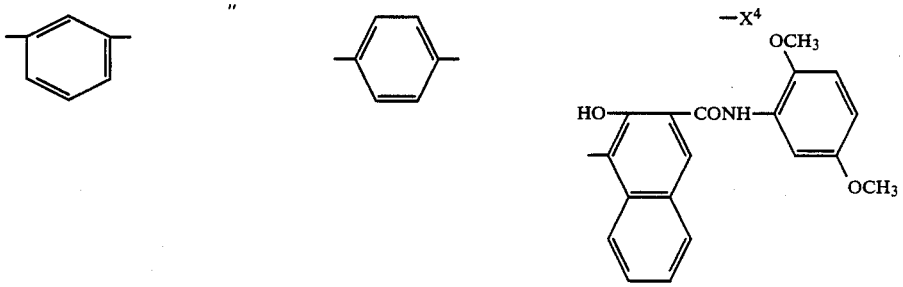
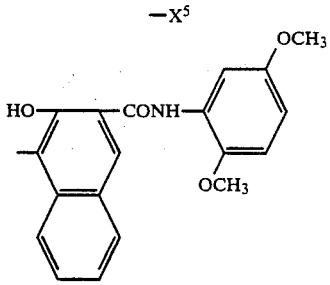
III-61
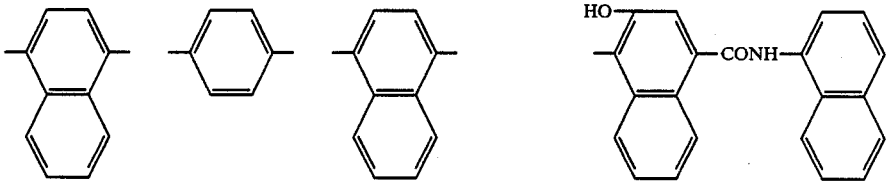

-continued
| | | | | |
|---|---|---|---|---|
| III-62 | 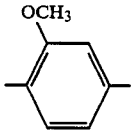 | " | 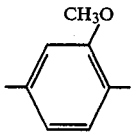 | 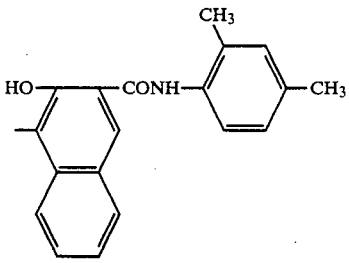 |
| III-63 | 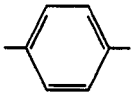 | " | 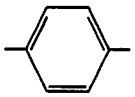 | 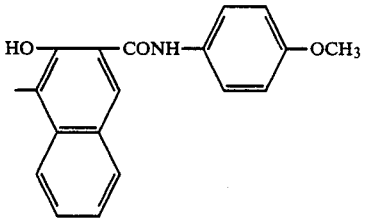 |
| III-64 | " | " | " | 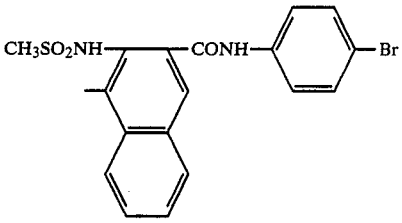 |
Exemplified Compounds [IV]:
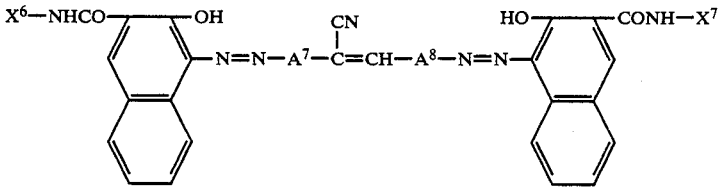
| Compound No. | $-A^7-$ | $-A^8-$ | $-X^6$, $-X^7$ |
|---|---|---|---|
| IV-1 | 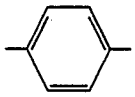 | 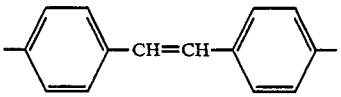 | 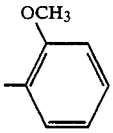 |
| IV-2 | " | " | 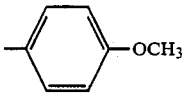 |
| IV-3 | " | " | 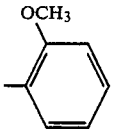 |
| IV-4 | " | " | $-X^6$ 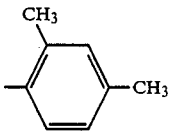 $-X^7$ |

-continued
| | | | |
|---|---|---|---|
| | | | 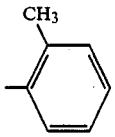 |
| IV-5 | " | 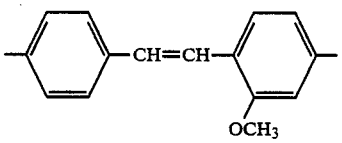 | 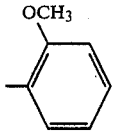 |
| IV-6 | 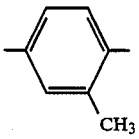 | 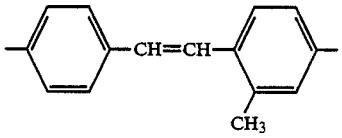 | 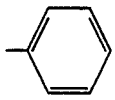 |
| IV-7 | 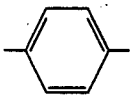 | 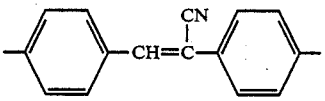 | 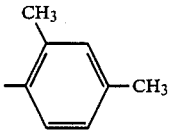 |
| IV-8 | 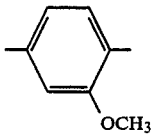 | 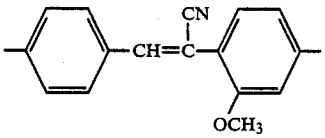 | 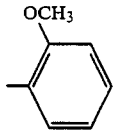 |
| IV-9 | 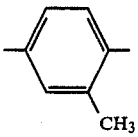 | 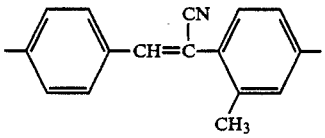 | 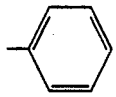 |
| IV-10 | 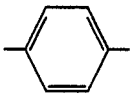 | 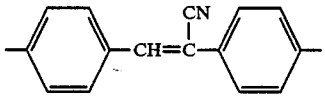 | 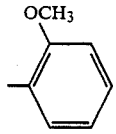 |
| IV-11 | " | " | 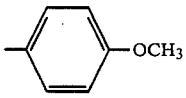 |
| IV-12 | " | " | 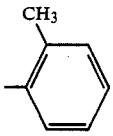 |
| IV-13 | 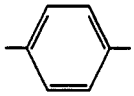 | 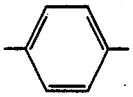 | 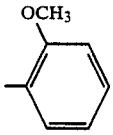 |
| IV-14 | " | " | 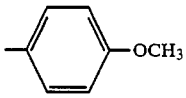 |

-continued
| | | | |
|---|---|---|---|
| IV-15 | " | " | 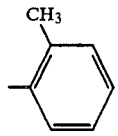 |
| IV-16 | " | " | 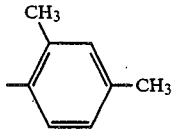 |
| IV-17 | 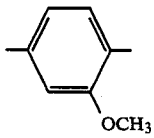 | " | 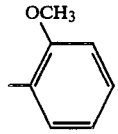 |
| IV-18 | 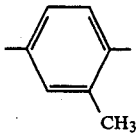 | " | 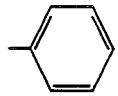 |
Exemplified Compounds [V]:
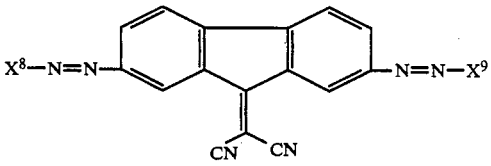
| Compound No. | $-X^8$, $-X^9$ |
|---|---|
| V-1 | 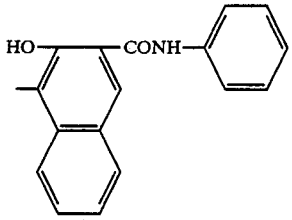 |
| V-2 | 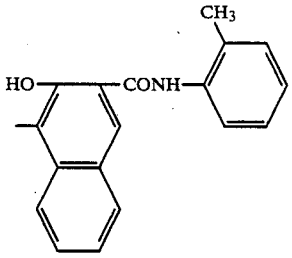 |
| V-3 | 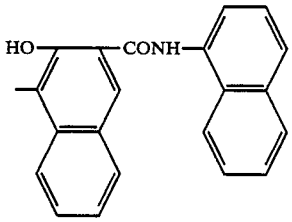 |

-continued
V-4
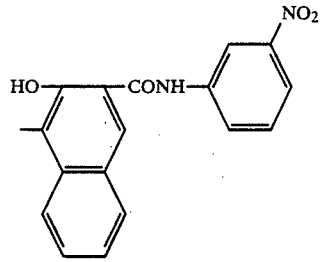
V-5
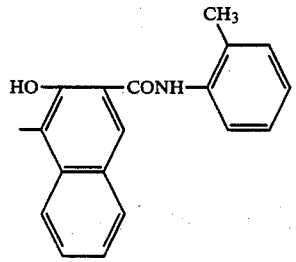
V-6
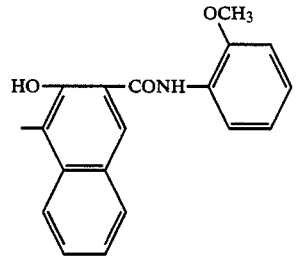
V-7
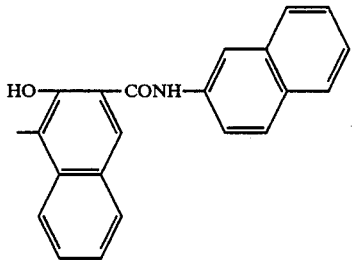
V-8
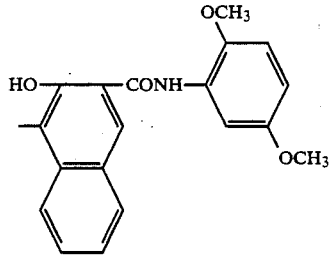
V-9
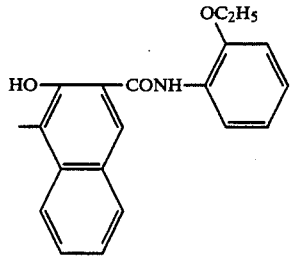

-continued
V-10
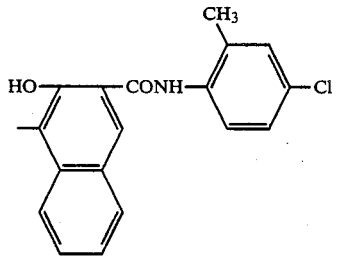
V-11
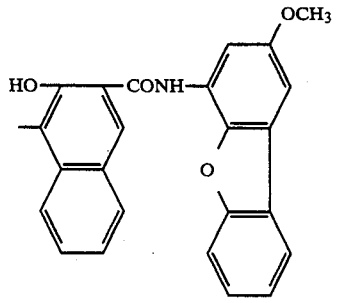
V-12
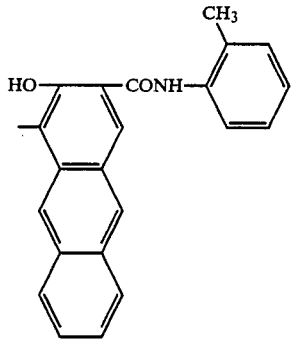
V-13
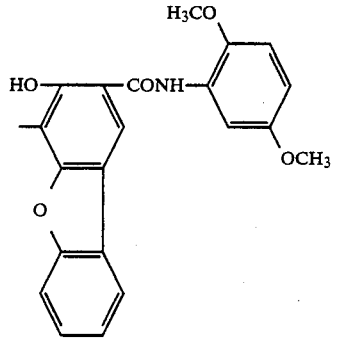
V-14
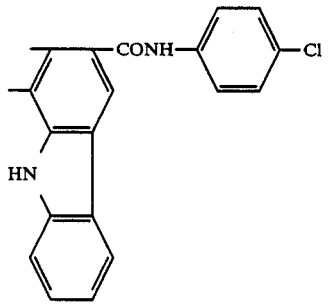

-continued
V-15
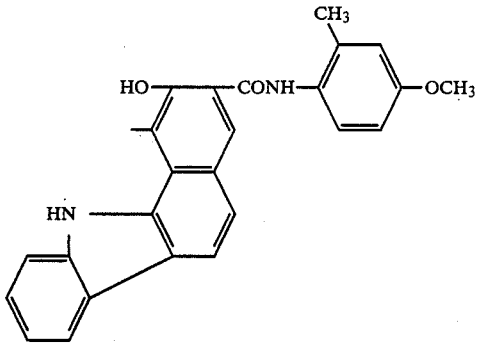
V-16
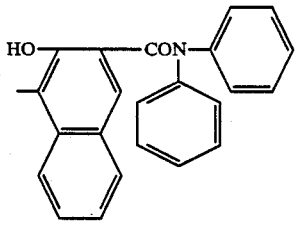
V-17
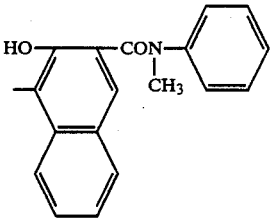
V-18
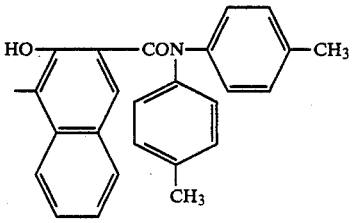
V-19
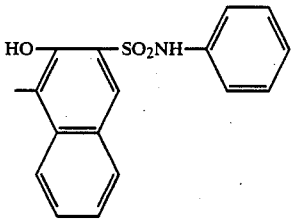
V-20
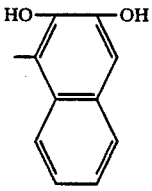

-continued
V-21
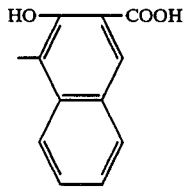
V-22
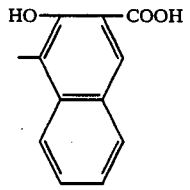
V-23
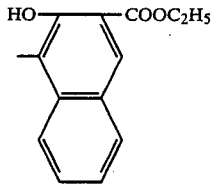
V-24
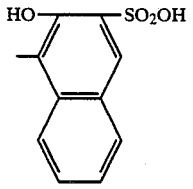
V-25
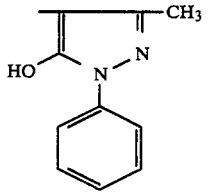
V-26
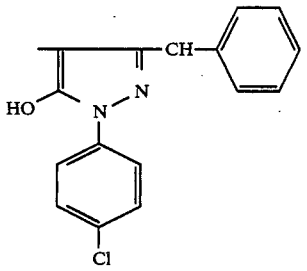
V-27
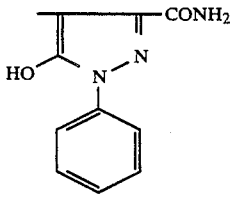

-continued

V-28

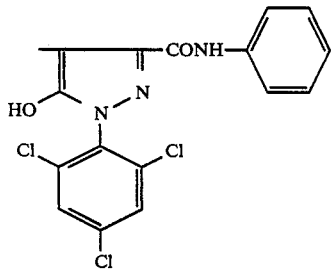

Pyrazoline compound, which represents following exemplified compounds (XVI) as CTM, is also applicable to use.

Exemplified Compounds [XVI]:

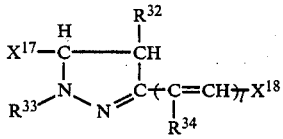

(l = 0 1)

| Compound No. | $-X^{17}$ | $-R^{32}$ | $-R^{33}$ | $-R^{34}$ | l | $-X^{18}$ |
|---|---|---|---|---|---|---|
| XVI-1 | $-C_6H_4-N(CH_3)_2$ | $-CH_3$ | $-C_6H_5$ | $-H$ | 1 | $-C_6H_4-N(CH_3)_2$ |
| XVI-2 | " | $-H$ | " | $-CH_3$ | " | " |
| XVI-3 | $-C_6H_4-N(C_2H_5)_2$ | $-CH_3$ | " | " | " | $-C_6H_4-N(C_2H_5)_2$ |
| XVI-4 | $-C_6H_4-OCH_3$ | " | " | $-H$ | " | $-C_6H_4-OCH_3$ |
| VVI-5 | " | $-H$ | " | $-CH_3$ | " | " |
| XVI-6 | $-C_6H_4-N(C_2H_5)_2$ | $-CH_3$ | $-C_6H_4-OCH_3$ | $-H$ | " | $-C_6H_4-N(C_2H_5)_2$ |
| XVI-7 | $-C_6H_4-N(CH_3)_2$ | " | $-C_6H_5$ | " | " | $-C_6H_4-OCH_3$ |
| XVI-8 | $-C_6H_4-OCH_3$ | " | " | " | " | $-C_6H_4-N(CH_3)_2$ |
| XVI-9 | $-C_6H_4-N(CH_3)_2$ | $-H$ | " | $-CH_3$ | " | $-C_6H_4-OC_2H_5$ |
| XVI-10 | $-C_6H_4-OC_2H_5$ | $-H$ | $-C_6H_5$ | $-CH_3$ | 1 | $-C_6H_4-N(C_2H_5)_2$ |
| XVI-11 | $-C_6H_4-N(C_2H_5)_2$ | $-C_6H_5$ | " | $-C_6H_5$ | " | $-C_6H_4-N(C_2H_5)_2$ |
| XVI-12 | $-C_6H_4-N(CH_3)_2$ | $-CH_3$ | " | $-H$ | " | $-N(CH_2-C_6H_4)_2$ |
| XVI-13 | $-C_6H_4-N(C_2H_5)_2$ | " | " | $-H$ | 0 | $-C_6H_4-N(C_2H_5)_2$ |
| XVI-14 | " | $-C_2H_5$ | " | " | 1 | " |
| XVI-15 | $-C_6H_4-N(C_4H_9)_2$ | $-H$ | " | $-C_3H_7$ | " | $-C_6H_4-OC_2H_5$ |

-continued

Exemplified Compounds [XVI]:

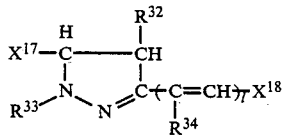

(l = 0 1)

| Compound No. | $-X^{17}$ | $-R^{32}$ | $-R^{33}$ | $-R^{34}$ | l | $-X^{18}$ |
|---|---|---|---|---|---|---|
| XVI-16 | $-C_6H_4-N(C_2H_5)_2$ | $-CH_2-C_6H_5$ | $-C_6H_4-OC_2H_5$ | $-H$ | " | $-C_6H_4-N(C_2H_5)_2$ |
| XVI-17 | " | $-H$ | $-C_6H_5$ | $-CH_2-C_6H_5$ | " | " |
| XVI-18 | $-C_6H_4-N(CH_3)_2$ | " | " | $-CH_3$ | " | $-C_6H_4-N(C_6H_5)_2$ |
| XVI-19 | $-C_6H_4-N(C_2H_5)_2$ | $-CH_3$ | " | $-H$ | " | $-C_6H_4-N(C_2H_5)_2$ |

Amine cmpound, which represents following exemplified compounds (XVII) as CTM, is also applicable to use.

Exemplified Compounds [XVII]:

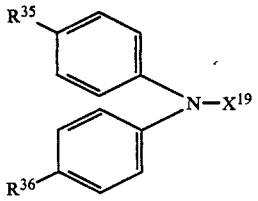

| Compound No. | $-R^{35}$ | $-R^{36}$ | $-X^{19}$ |
|---|---|---|---|
| XVII-1 | $-H$ | $-H$ | $-C_6H_5$ |
| XVII-2 | " | " | $-C_6H_4-Cl$ |
| XVII-3 | $-Br$ | $-Br$ | $-C_6H_4-Br$ |
| XVII-4 | $-H$ | $-H$ | $-C_6H_4-OH$ |
| XVII-5 | " | " | $-C_6H_4-CH_3$ |

-continued
Exemplified Compounds [XVII]:
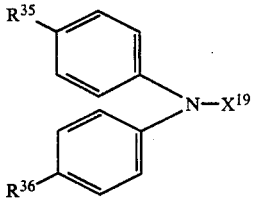
| Compound No. | $-R^{35}$ | $-R^{36}$ | $-X^{19}$ |
|---|---|---|---|
| XVII-6 | " | " | 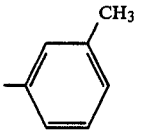 |
| XVII-7 | " | " | 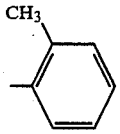 |
| XVII-8 | $-CH_3$ | $-H$ | 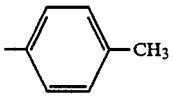 |
| XVII-9 | " | $-CH_3$ | " |
| XVII-10 | $-H$ | $-H$ | 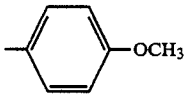 |
| XVII-11 | $-H$ | $-H$ | 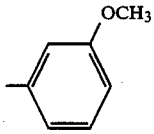 |
| XVII-12 | " | " | 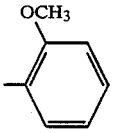 |
| XVII-13 | $-OCH_3$ | " | 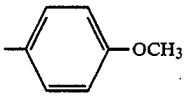 |
| XVII-14 | " | $-OCH_3$ | " |
| XVII-15 | $-CH_3$ | $-H$ | " |
| XVII-16 | $-H$ | " | 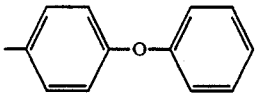 |
| XVII-17 | " | " | 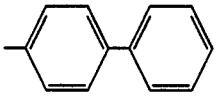 |
| XVII-18 | " | " | 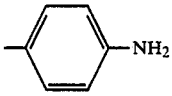 |

-continued
Exemplified Compounds [XVII]:
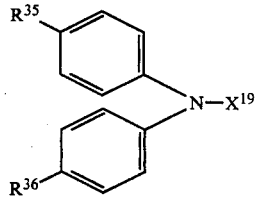
| Compound No. | $-R^{35}$ | $-R^{36}$ | $-X^{19}$ |
|---|---|---|---|
| XVII-19 | " | " | 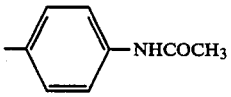  |
| XVII-20 | —H | —H | 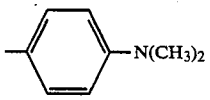  |
| XVII-21 | —H | —H | 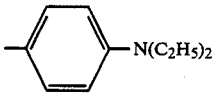  |
| XVII-22 | " | " | 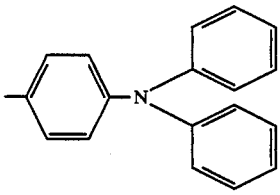  |
| XVII-23 | " | " | 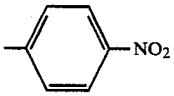  |
| XVII-24 | $-NO_2$ | " | 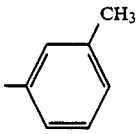  |
| XVII-25 | —H | " | 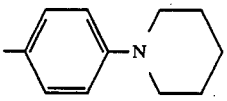  |
| XVII-26 | " | " | 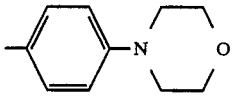  |
| XVII-27 | " | " | 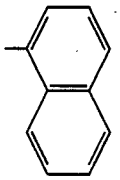 |
| XVII-28 | $-CH_3$ | $-CH_3$ | " |

-continued

Exemplified Compounds [XVII]:

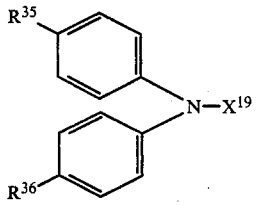

| Compound No. | $-R^{35}$ | $-R^{36}$ | $-X^{19}$ |
|---|---|---|---|
| XVII-29 | —H | —H | 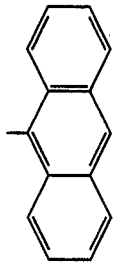 |
| XVII-30 | $-CH_3$ | $-CH_3$ | 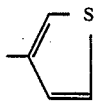 |
| XVII-31 | —H | —H | 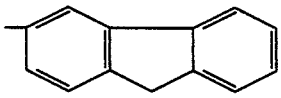 |
| XVII-32 | $-CH_3$ | $-CH_3$ | 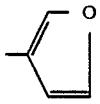 |
| XVII-33 | —H | —H | 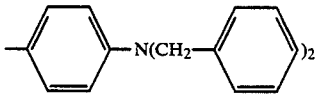 |

In the photoconductive layers of a photoconductive element of the invention, the layer structures thereof include a multi-layered structure and a single-layered structure. For the purposes of improving a sensitivity, reducing either residual potential or the fatigue caused in repeating use, and the like, it is allowed to contain one or more kinds of electron acceptors in any one of CTL, CGL, a single-layered photoconductive layer and OCL or plural layers.

The electron acceptable substances which may be applied to the photoreceptors of the invention include, for example, succinic acid anhydride, maleic acid anhydride, dibromomaleic acid anhydride, phthalic acid anhydride, tetrachlorophthalic acid anhydride, tetrabromophthalic acid anhydride, 3-nitrophthalic acid anhydride, 4-nitrophthalic acid anhydride, pyromellitic acid anhydride, mellitic acid anhydride, tetracyanoethylene, tetracyanoquinodimethane, o-dinitrobenzene, m-dinitrobenzene, 1,3,5-trinitrobenzene, paranitrobenzonitrile, picryl chloride, quinonechlorimide, chloranil, bromanil, 2-methylnaphthoquinone, dichlorodicyanoparabenzoquinone, anthraquinone, dinitroanthraquinone, tri-nitrofluorenone, 9-fluorenylidene [dicyanomethylenemalonodinitrilel, polynitro-9-fluorenylidene-[dicyanomethylenemalonodinitrile], picric acid, o-nitrobenzoic acid, p-nitrobenzoic acid, 3,5-dinitrobenzoic acid, pentafluorobenzoic acid, 5-nitrosalicylic acid, 3,5-dinitrosalicylic acid, phthalic acid and so forth.

In the invention, the binder resins which may be used in the photoconductive layers include, for example; addition-polymer type resins, polyaddition type resins and polycondensation type resins, such as polyethylenes, polypropylenes, acrylic resins, methacrylic resins, vinyl chloride resins, vinyl acetate resins, epoxy resins, polyurethane resins, phenol resins, polyester resins, alkyd resins, polycarbonate resins, silicone resins, melamine resins and so forth; copolymer resins each containing two or more repetition units of the above-given resins, including insulating resins such as vinyl chloride-vinyl acetate copolymer resins, vinyl chloride-vinyl acetate-maleic anhydride copolymers and so forth; and, besides, macromolecular organic semiconductors such as poly-N-vinyl carbazole and so forth.

The aforementioned interlayers function as an adhering layer, a barrier layer or the like. They include, besides the above-given binder resins, for example, polyvinyl alcohols, ethyl cellulose, carboxymethyl cellulose, vinyl chloride-vinyl acetate copolymers, vinyl chloride-vinyl acetate-maleic anhydride copolymers, casein, N-alkoxymethylated Nylon, starch and so forth.

Next, the electroconductive substrate capable of supporting the aforementioned photoconductive layers include, for example, a metallic plate, drum or foil made of aluminium, nickel or the like; a plastic film deposited thereon with aluminium, tin oxide, indium oxide or the like; or a sheet of paper or a film or drum made of plastics or the like coated thereon with an electroconductive substance.

CGL may be provided either in such a method that the aforementioned CGM is vacuum-deposited over to the abovementioned support or such a method that CGM is dissolved or dispersed independently or together with an appropriate binder resin in an appropriate solvent and the resulted solution or dispersion is coated over and is taken dried up.

In the case that CGL is formed by dispersing the above-mentioned CGM, it is preferred that the CGM is in the form of power-like grains having an average grain size of not larger than 2 μm, and more preferably, not larger than 1 μm. In other words, if the CGM grains are too large in size, CGM is hardly dispersed in a layer and the grains are partly protruded over the layer surface so that the surface smoothness may be deteriorated. In some instance, it is apt to cause a discharge in the portions where the grains are protruded, or to cause the so-called toner filming phenomenon that toner grains adhere to the grain-protruded portions. On the other hand, if the grains are too small in size, they are apt to cohere together, so that sometimes the resistance of layes may raise, the sensitivity and repetition characteristics may be deteriorated by increasing crystal defects, or there may be a limit to make grains fine. It is, therefore, desirable to set the lower limit of average grain size to 0.01 μm.

CGL may be provided in the following method. Namely, the above-mentioned CGM is finely grained in a dispersion medium by making use of a ball-mill, a homomixer or the like, and a dispersion is prepared by adding binder resins and mixedly dispersed, so that the resulted dispersion is coated over. In this method, grains may be uniformly dispersed when the grains are dispersed by the agency of supersonic waves.

The solvents used for forming CGL include, for example, N,N-dimethylformamide, benzene, toluene, xylene, monochlorobenzene, 1,2-dichloroethane, dochloromethane, 1,1,2-trichloroethane, tetrahydrofuran, methylethylketone, ethyl acetate, butyl acetate and so forth.

The proportion of CGM to 100 parts by weight of the binder resins contained in CGL may be within the range of 20 to 200 parts by weight and, more preferably, from 25 to 100 parts by weight. If a CGM content is less than the above-given proportion, a photosensitivity will be lowered so that residual potential may be increased. If it is more than that proportion, a dark decay will be increased and an acceptable potential capacity will be lowered.

In the case of the CGL structure for applying a positive charge, the thickness of the CGL is, preferably, from 1 to 10 μm and, particularly, from 3 to 7 μm. In the case of the CGL structure for applying a negative charge, the thickness thereof is, preferably, from 0.01 to 10 μm and, particularly, from 0.1 to 3 μm.

To be more concrete, in the case of the structure for applying a positive charge, CGL is arranged as the furface layer and the structure will lack in scratch resistance. It is therefore needed to make the CGL layer thicker so as to improve the durability of the structure. If the layer is thickened, the sensitivity will be lowered. There is a means for inhibiting the above-mentioned sensitivity lowering, in which CTM is added into CGL. However, CTM has such a structure as is apt to be affected by an ozone-oxidation as compared to CGM. Therefore, the durability of a photoreceptor will be damaged because the photoconductive element is readily deteriorated by ozone.

This invention is effective both in using the above-mentioned positively charged photoconductive element and in preventing the photoreceptors from the deterioration caused by ozone-oxidation. The invention is further capable of inhibiting a sensitivity lowering.

CTL may also be formed by applying the aforementioned CTM thereto in the same manner as in the above-mentioned CGM. Namely, CTL may be formed by dissolving and dispersing the CTM independently or together with the above-mentioned binder resins and the resulted coating dispersion is coated and dried.

In the CTL, an amount of CTM added thereto may be in a proportion of from 20 to 200 parts by weight and, preferably, from 30 to 150 parts by weight per 100 parts by weight of the binder resins.

If the proportion of CTM is less than the above, a photosensitivity may be deteriorated and residual potential may be raised. If it is more than that, a solvent solubility may be deteriorated.

The thickness of the CTL thus formed should be preferably 5 to 50 μm and, particularly, 5 to 30 μm.

It is also preferred that the thickness ratio of CGL to CTL should be 1:1 to 1:30.

In the case of the above-mentioned single-layered structure, the proportion of a CGM content to the binder resins is preferably 20 to 200 parts by weight and more preferably 25 to 100 parts by weight to 100 parts by weight of the binder resins.

If the proportion of the CGM content is less than the above, a photosensitivity may be lowered to induce the increase of residual potential. If it is more than that, a dark decay and acceptable potential capacity may be lowered.

Next, the proportion of a CTM content of the binder resins should be from 20 to 200 parts by weight and more preferably 30 to 150 parts by weight per 100 parts by weight of the binder resins.

If the proportion of the CTM is less than the above, a photosensitivity may be deteriorated and residual potential may be raised. If it is more than that, a solvent solubility may be deteriorated.

In a photoconductive layer of single-layered structure, the quantitative ratio of CTM to CGM should preferably be from 1:3 to 1:2 by weight.

As for the binders used in a protective layer provided if required in the invention, transparent resins may be used, provided that the volume resistivity thereof should be not less than $10^8\Omega$.cm, preferably not less than $10^{10}\Omega$.cm and more preferably not less than $10^{13}\Omega$.cm. The above-mentioned binders are to contain a resin which may be hardened by light or heat in an amount of at least 50 weight% or more.

The resins which may be hardened by light or heat include, for example, a thermosetting acrylic resin, a silicone resin, an epoxy resins, a urethane resin, a urea resin, a phenol resin, a polyester resin, an alkyd resin, a melamine resin, a photosetting cinnamic acid resin, or the copolymeric or copolycondensed resins thereof.

Besides the above, any one of the photo- or thermo-setting resins applicable to electrophotographic materials may be utilized. For the purpose of improving workability and physical properties, such as the prevention of a crack, the investment of softness and so forth, if occasion demands, it is allowed to contain a thermoplastic resin in an amount of less than 50 weight% into the above-mentioned protective layer. The above-mentioned thermoplastic resins applicable thereto include, for example, a polypropylene, an acrylic resin, a methacrylic resin, a vinyl chloride resin, a vinyl acetate resin, an epoxy resin, a butylal resin, a polycarbonate resin, and a silicone resin; or the copolymeric resins thereof, such as a vinyl chloride-vinyl acetate copolymer resin and a vinyl chloride-vinyl acetate-maleic acid anhydride copolymer resin; macromolecular organic semiconductors such as a poly-N-vinyl carbazole and so forth; and, besides, any of the thermoplastic resins which may be applied to electrophotographic materials.

The above-mentioned protective layers are also allowed to contain an electron acceptable substance and, besides, a UV absorbent and so forth, if required, for the purpose of protecting CGL. These additives are dissolved in a solvent together with the above-mentioned binders, and the resulted solution is coated and dried in such a method as a dip-coating, spray-coating, blade-coating, roller-coating or the like coating method so that the protective layer thickness may be not thicker than 2 μm and more preferably not thicker than 1 μm.

EXAMPLES

The invention will now be described with reference to the following examples. It is, however, to be understood that the embodiments of the invention shall not be limited thereto.

EXAMPLE 1

On an aluminium-deposited polyester film support, an intermediate layer comprising a polyvinyl butylal resin, 'XYHL' manufactured by Union Carbide Co., was so formed as to have a thickness of 0.2 μm.

Next, one part by weight of Exemplified Compound V-15 was dispersed in a solution of 0.5 parts by weight of polycarbonate resin, 'Panlite L-1250' manufactured by Teijin Chemical Industrial Co., and 120 parts by weight of 1,2-di-chlorethane, by spending 10 hours with a sand-mill, and the resulted dispersion was coated by a wire-bar, so that CGL of 0.2 μm in thickness was formed.

Successively, 1.2 parts by weight of Exemplified Compound A-1 were added to a solution of 12 parts by weight of Exemplified Compound XV-9, 15 parts by weight of a polycarbonate resin, 'Panlite K-1300' manufactured by Teijin Chemical Industrial Co., and 120 parts by weight of 1,2-di-chlorethane. The resulted solution was coated by a blade coater to form a CTL of 23 μm in thickness. The resulted photoconductive element of the invention is hereby named Sample 1.

COMPARATIVE EXAMPLE 1

A comparative photoconductive element prepared in the same manner as in the above-mentioned Example 1, except that Exemplified Compound A-1 used in Example 1 was omitted. The resulted photoconductive element is here by named Comparative Sample 1.

EXAMPLES 2 THROUGH 6

Each of the photoconductive element of the invention was prepared in the same manner as in the above-mentioned Example 1, except that each of Exemplified Compounds, V-15 for CGM, XV-9 for CTM and A-1 for an improving agent was replaced by those shown in Table-1. Thus obtained photoconductive element of the invention are hereby named Samples 2 through 6, respectively.

COMPARATIVE EXAMPLES 2 THROUGH 6

Each of the comparative photoconductive element was prepared in the same manner as in Examples 2 through 6, except that Exemplified Compounds A-1 through A-12 each for the improving agents were omitted.

In Sample 2 and Comparative Sample 2, the thickness of each CGL was adjusted to be 0.8 μm only when Exemplified Compound VI-3 was coated as CGM.

TABLE 1

| Sample No. | Charge generating substance | Charge transport substance | Improving agent |
|---|---|---|---|
| Inv. Sample 1 | Exemplified compound V-15 | Exemplified compound XV-9 | Exemplified compound A-1 |
| Comp. Sample 1 | Exemplified compound V-15 | Exemplified compound XV-9 | None |
| Inv. Sample 2 | Exemplified compound VI-3 | Exemplified compound IX-44 | Exemplified compound A-1 |
| Comp. Sample 2 | Exemplified compound VI-3 | Exemplified compound IX-44 | None |
| Inv. Sample 3 | Exemplified compound I-1 | Exemplified compound XV-25 | Exemplified compound A-2 |
| Comp. Sample 3 | Exemplified compound I-1 | Exemplified compound XV-25 | None |
| Inv. Sample 4 | Exemplified compound IV-7 | Exemplified compound XII-8 | Exemplified compound A-5 |
| Comp. Sample 4 | Exemplified compound IV-7 | Exemplified compound XII-8 | None |
| Inv. Sample 5 | Exemplified Azulenium salt compound AZ | Exemplified compound X-14 | Exemplified compound A-12 |
| Comp. Sample 5 | Exemplified Azulenium salt compound AZ | Exemplified compound X-14 | None |
| Inv. Sample 6 | type phthalo-cyanine | Exemplified compound XVII-14 | Exemplified compound A-12 |
| Comp. Sample 6 | type phthalo- | Exemplified | None |

TABLE 1-continued

| Sample No. | Charge generating substance | Charge transport substance | Improving agent |
|---|---|---|---|
| | cyanine | compound XVII-14 | |

Azulenium salt, AZ

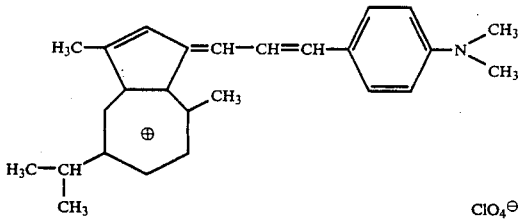

Evaluation 1

With respect to each of the samples obtained in the above-mentioned Examples 1 through 6 and Comparative Examples 1 through 6, the following evaluation was made. Namely, the samples were loaded in an electrostatic tester. Model SP-428 manufactured by Kawaguchi Electric Works, and ozone gas was generated by an ozone generator, Model 0-1-2 manufactured by Nippon Ozone Co., Ltd. Ozone gas thus generated was introduced into the sample-loaded electrostatic tester, and the ozone concentration inside the tester was adjusted to 90 ppm.

After the samples were applied with a negative corona-charge for 5 seconds under the discharging conditions of 40 μA and were than allowed to stand for another 5 seconds, the surface potential $V_0$[V], i.e., the initial potential, of each sample was measured. Successively, the examples were exposed to white light and each of the exposure amounts, $E_{50}^{500}$ [lux.sec] which is necessary to lower the surface potential of −500[V] down to −50[V], was measured. After the same procedures were repeated one hundred times, the initial potential $V_{100}$ was measured after the 100th procedure was completed, so that each of the initial potential holding ratios, $V_{100}/V_0$, was obtained. The resulted ratios were regarded so the evaluation of ozone-proof property of the samples.

The results of the measurements are shown in Table-2.

TABLE 2

| Sample No. | $V_0$[V] | $E_{50}^{500}$ [lux · Sec] | $V_{100}/V_0$ |
|---|---|---|---|
| Inv. Sample 1 | −1480 | 3.5 | 0.99 |
| Comp. Sample 1 | −1205 | 3.5 | 0.65 |
| Inv. Sample 2 | −1450 | 5.5 | 0.98 |
| Comp. Sample 2 | −1350 | 5.6 | 0.75 |
| Inv. Sample 3 | −1550 | 4.4 | 1.00 |
| Comp. Sample 3 | −1320 | 4.3 | 0.72 |
| Inv. Sample 4 | −1250 | 5.8 | 0.85 |
| Comp. Sample 4 | −1030 | 5.6 | 0.61 |
| Inv. Sample 5 | −1380 | 5.4 | 0.86 |
| Comp. Sample 5 | −1070 | 5.3 | 0.59 |
| Inv. Sample 6 | −1410 | 5.3 | 0.93 |
| Comp. Sample 6 | −1230 | 5.2 | 0.83 |

EXAMPLE 7

Exemplified Compound VI-3 of 5 parts by weight, Exemplified Compound IX-15 of 8 parts by weight. Exemplified Compound A-5 of 1 part by weight and 1,2-dichlorethane of 200 parts by weight, with a sand mill expending 8 hours. The resulted dispersion was blade-coated over an electroconductive support comprising a polyester film deposited with aluminium thereon, so that a photoconductive layer having a thickness of 15 μm was formed. The resulted photoconductive element is hereby named Sample 7.

COMPARATIVE EXAMPLE 7

A phottoconductive element for comparative use was prepared in the same manner as in the above-mentioned Example 7, except that Exemplified Compound A-5 was omitted to use. The resulted photoconductive element is hereby named Comparative Sample 7.

Evaluation 2

The evaluation of Example 7 and Comparative Example 7 were made in the same manner as in Evaluation 1, except that the negative corona charge was replaced by a positive corona charge.

The results of the evaluation are shown in the following Table-3.

TABLE 3

| Example No. | Sample No. | $V_0$[V] | $E_{50}^{500}$ [lux · Sec] | $V_{100}/V_0$ |
|---|---|---|---|---|
| Invention Example 7 | Invention Sample 7 | 1250 | 6.5 | 0.85 |
| Comparative Example 7 | Comparative Sample 7 | 1130 | 6.7 | 0.40 |

EXAMPLE 8

In a dip-coating method, an intermediate layer comprising polyhydroxystyrene resin, 'Resin M' manufactured by Maruzen Oil Co., Ltd., and having a thickness of 0.5 μm was formed on an electroconductive support comprising an aluminium drum.

Next, Exemplified Compound V-15 of 1 part by weight, polyvinyl formal resin, 'Denka Formal #20', of 0.6 parts by weight and 1,2-dichloroethane of 100 parts by weight were dispersed by a sand mill expending 10 hours. The resulted dispersion was coated in a dip-coating method, so that CGL having a thickness of 0.25 μm was formed.

Further, a solution of Exemplified Compound IX-36 of 12 parts by weight, Exemplified Compound A-1 of 1.2 parts by weight, polycarbonate resin, 'Panlite K-1300' of 16 parts by weight and 1,2-dichloroethane of 120 parts by weight was coated in a dip-coating method, so that CTL of 22 μm in thickness was formed. Thus, a photoconductive element of the invention was obtained. The photoconductive element is hereby named Sample 14.

COMPARATIVE EXAMPLE 8

A comparative photoconductive element was prepared in the same manner as in Example 8, except that Exemplified Compound A-1 was omitted. The resulted photoconductive element is hereby named Comparative Sample 14.

COMPARATIVE EXAMPLE 9

A comparative photoconductive element was prepared in the same manner as in Example 8, except that Exemplified Compound A-1 was replaced by the following Compound B. The resulted photoconductive element is hereby named Comparative Sample 9.

COMPARATIVE EXAMPLE 10

A comparative photoconductive element was prepared in the same manner as in Example 8, except that Exemplified Compound A-1 was replaced by the following Compound C. The resulted photoconductive element is hereby named Comparative Sample 10.

COMPARATIVE EXAMPLE 11

A comparative photoconductive element was prepared in the same manner as in Example 8, except that 1.2 parts by weight of Exemplified Compound A-1 was replaced by 0.8 parts by weight of the following Compound B and 0.4 parts by weight of the following Compound C. The resulted photoconductive element is hereby named Comparative Sample 11.

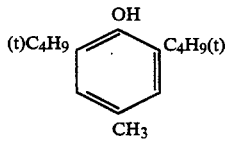

Compound B

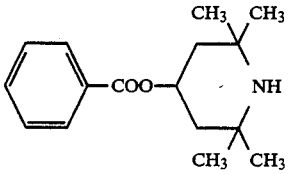

Compound C

COMPARATIVE EXAMPLE 12

A comparative photoconductive element was prepared in the same manner as in Example 8, except that 1.2 parts by weight of Exemplified Compound A-1 was replaced by the following Compound D. The resulted photoconductive element is hereby named Comparative Sample 12.

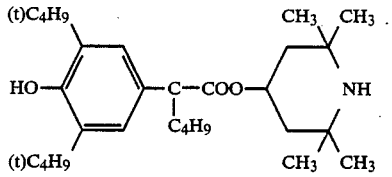

Compound D

Evaluation 3

With respect to each of the samples obtained in Example 8 and Comparative Examples 8 through 12, the variations of both charge potential $V_B$[V] and post-exposure potential $V_W$[V] were measured according to Carlson Process in which a series of the processes of a negative charge, an exposure to light and an electric neutralization was repeated 10,000 times under such a condition that an ozone concentration around a charge electrode should be 50 ppm.

The results of the measurements are shown in the following Table-4.

TABLE 4

| Example No. | Sample No. | $V_B$[V] in process After 1st | $V_B$[V] in process After 10,000th | $V_W$[V] in process After 1st | $V_W$[V] in process After 10,000th |
|---|---|---|---|---|---|
| Inv. 8 | Inv. 8 | −720 | −720 | −50 | −50 |
| Comp. 8 | Comp. 8 | −590 | −345 | −50 | −20 |
| Comp. 9 | Comp. 9 | −700 | −610 | −70 | −50 |
| Comp. 10 | Comp. 10 | −720 | −700 | −70 | −80 |
| Comp. 11 | Comp. 11 | −700 | −680 | −70 | −75 |
| Comp. 12 | Comp. 12 | −720 | −710 | −70 | −75 |

As is obvious from the Table above, the photocondutive element of the invention is remarkably superior to the comparative samples especially in charge potentials and environmentl compatibility. In spite of the common fact that $V_W$ is raised, that is, a sensitivity is lowered, when a charge potential is improved, the photoconductive element of the invention has no rise in $V_W$ and few variation in both $V_B$ and $V_W$, as compared to Comparative Samples 7 through 12. Further, the different point of Compound D contained in Comparative Sample 12 is only in a part of hindered amine structure of N-H instead of that of N-alkyl, and $V_W$ is raised in Compound D, as compared to the compound of the invention. It is, therefore understandable that the invention is superior to Compound D.

Evaluation 4

With respect to Example 8 and Comparative Examples 8 through 12, the post-exposure potentials $V_W$ at various temperatures were measured, respectively, and the temperature dependency of $V_W$ thereof were also checked up.

The results thereof are shown in Table-5 below.

TABLE 5

| Sample No. | VW [[ at each temperature at 5° C. | at 25° C. | at 45° C. |
|---|---|---|---|
| Sample 8 | −80 | −50 | −40 |
| Comp. Sample 8 | −80 | −50 | −40 |
| Comp. Sample 9 | −110 | −70 | −50 |
| Comp. Sample 10 | −140 | −70 | −50 |
| Comp. Sample 11 | −130 | −70 | −50 |
| Comp. Sample 12 | −120 | −70 | −50 |

It is understandable that the photoconductive element of the invention is excellent in temperature dependency, as compared to Comparative Samples.

ADVANTAGES OF THE INVENTION

With the photoconductive element of the invention, the excellent advantages can be enjoyed in environmental compatibility.

In particular, the photoconductive element of the invention can display the remarkably improved effects on the phenomena such as a chargeability deterioration, the increase in dark conductivity or the like, which may be caused by ozone or other active substances produced when a charge is applied. Further in the photoconductive element of the invention, the effects can be displayed on the rise of potentials and the decrease in dark decay and, therefore, the excellent characteristics can be displayed, such as an initial characteristics and very few fatigue and deterioration induced in repetitive use, even under the circumstances of a low ozone concentration.

What is claimed is:

1. A photoconductive element comprising an electroconductive substrate and a photoconductive layer containing a photoconductive substance, said photoconductive layer containing a compound which has in its molecular structure a hindered amine structure unit represented by formula Ia and a hindered phenol structure unit represented by formula Ib;

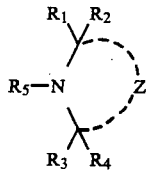
[Ia]

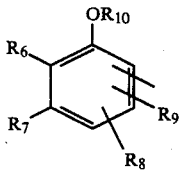
[Ib]

wherein, $R_1$, $R_2$, $R_3$ and $R_4$ are independently a hydrogen atom, an alkyl group or an aryl group; Z represents a group of atoms necessary to complete a nitrogen-containing alicyclic group; $R_5$ represents an alkyl group;

$R_6$ is a branched alkyl group; $R_7$, $R_8$ and $R_9$ are independently a hydrogen atom, a hydroxy group, an alkyl group or an aryl group; and $R_{10}$ is a hydrogen atom, an alkyl group or an alkenyl group; provided that said hindered amine structure unit is connected through one of $R_1$, $R_2$, $R_3$, $R_4$, $R_5$ and Z thereof, optionally through a divalent organic group and/or one of $R_6$, $R_7$, $R_8$, $R_9$ and $R_{10}$, with said hindered phenol structure unit, and that $R_8$ and $R_9$ may be connected with each other to form a ring.

2. The photoconductive element according to claim 1, wherein said photoconductive layer contains charge generating material and a charge transporting material.

3. The photoconductive element according to claim 2, wherein said $R_1$ and $R_2$ independently represent an alkyl group.

4. The photoconductive element according to claim 3, wherein said hindered amine structure unit is connected through a divalent organic group with said hindered phenol structure unit, said divalent organic group being an alkylene bondage, an ether bondage, an ester bondage, an amine bondage or an amide bondage.

5. The photoconductive element according to claim 4, wherein another divalent organic group contains an ester bondage.

6. The photoconductive element according to claim 5, wherein said $R_{10}$ is a hydrogen atom.

7. The photoconductive element according to claim 5, wherein said compound is contained in an amount ranging from 0.01 to 70 parts by weight with respect to 100 parts by weight of said charge generating material.

8. The photoconductive element according to claim 5, wherein said compound has a molecular weight of not more than 1500.

9. The photoconductive element according to claim 2, wherein said photoconductive element comprises, on the electroconductive substrate, a photoconductive layer consisting of at least one charge generating layer containing said charge generating material or consisting of at least one charge generating layer containing said charge generating material and also containing said charge transporting material, and at least one charge transporting layer containing said charge transporting material, and a protective layer provided on said photoconductive layer and said compound being incorporated into least one of said charge generating layer, said charge transporting layer and said protective layer.

10. The photoconductive element according to claim 9, wherein said compound is incorporated into said charge generating layer or said protective layer.

11. The photoconductive element according to claim 9, wherein said photoconductive element further comprises a subbing layer between the substrate and said photoconductive layer.

12. The photoconductive element according to claim 10, wherein said photoconductive element further comprises a subbing layer between the substrate and said photoconductive layer.

* * * * *